US007895981B2

(12) United States Patent
Bösl-Flierl et al.

(10) Patent No.: US 7,895,981 B2
(45) Date of Patent: Mar. 1, 2011

(54) VARIABLE VALVE LIFT DEVICE FOR THE LIFT ADJUSTMENT OF GAS-EXCHANGE VALVES OF AN INTERNAL COMBUSTION ENGINE

(75) Inventors: Gerlinde Bösl-Flierl, Kaiserslautern (DE); Rudolf Flierl, Kaiserslautern (DE); Wilhelm Hannibal, Hemer (DE); Michael Jubelt, Chemnitz (DE); Andreas Knecht, Kusterdingen (DE); Andreas Wild, Unterensingen (DE)

(73) Assignees: enTec Consulting GmbH (DE); Hydraulik-Ring GmbH (DE)

( * ) Notice: Subject to any disclaimer, the term of this patent is extended or adjusted under 35 U.S.C. 154(b) by 925 days.

(21) Appl. No.: 10/550,938

(22) PCT Filed: Mar. 26, 2004

(86) PCT No.: PCT/EP2004/003264

§ 371 (c)(1), (2), (4) Date: Mar. 19, 2007

(87) PCT Pub. No.: WO2004/088094

PCT Pub. Date: Oct. 14, 2004

(65) Prior Publication Data

US 2007/0266971 A1 Nov. 22, 2007

(30) Foreign Application Priority Data

| | | |
|---|---|---|
| Mar. 29, 2003 | (DE) | 103 14 683 |
| May 14, 2003 | (DE) | 103 23 665 |
| Nov. 3, 2003 | (DE) | 103 52 677 |
| Jan. 8, 2004 | (DE) | 10 2004 001 343 |
| Jan. 22, 2004 | (DE) | 10 2004 003 327 |

(51) Int. Cl.
*F01L 1/18* (2006.01)

(52) U.S. Cl. ..... 123/90.39; 123/90.16; 123/90.44; 74/559

(58) Field of Classification Search ..... 123/90.16, 123/90.39, 90.44; 74/555, 567, 569
See application file for complete search history.

(56) References Cited

U.S. PATENT DOCUMENTS

| | | | |
|---|---|---|---|
| 5,215,048 | A | 6/1993 | Kaiser et al. |
| 5,373,818 | A | 12/1994 | Unger |
| 5,601,056 | A | 2/1997 | Kuhn et al. |

(Continued)

FOREIGN PATENT DOCUMENTS

| | | |
|---|---|---|
| DE | 8029475.3 | 6/1982 |

(Continued)

*Primary Examiner* — Ching Chang

(57) ABSTRACT

In order to produce a variable valve lift device for the lift adjustment of the gas-exchange valves of an internal combustion engine, by means of which with adjustment forces and holding forces, independently from whether said holding forces and adjustment forces are applied mechanically, hydraulically or electrically, with an adjustment of the valve lift being as cost-effective as possible, and with maximum accuracy of the adjustment or control of the valve lift to be taken between the individual cylinders of a multi-cylinder internal combustion engine, and, moreover, the adjustment possibility of the valve lift of the valves of an internal combustion engine with several cylinders is obtained within smallest tolerances, it is suggested that a valve lift device (1) has a rotatable eccentric shaft (3), which consists of several eccentrics (4, 5) and whereby all possible contours of the eccentrics (4, 5) are positioned within a circle, which is formed by means of the external diameters of a bearing (6, 7) of the eccentric shaft (3).

22 Claims, 16 Drawing Sheets

U.S. PATENT DOCUMENTS

Figure 1:
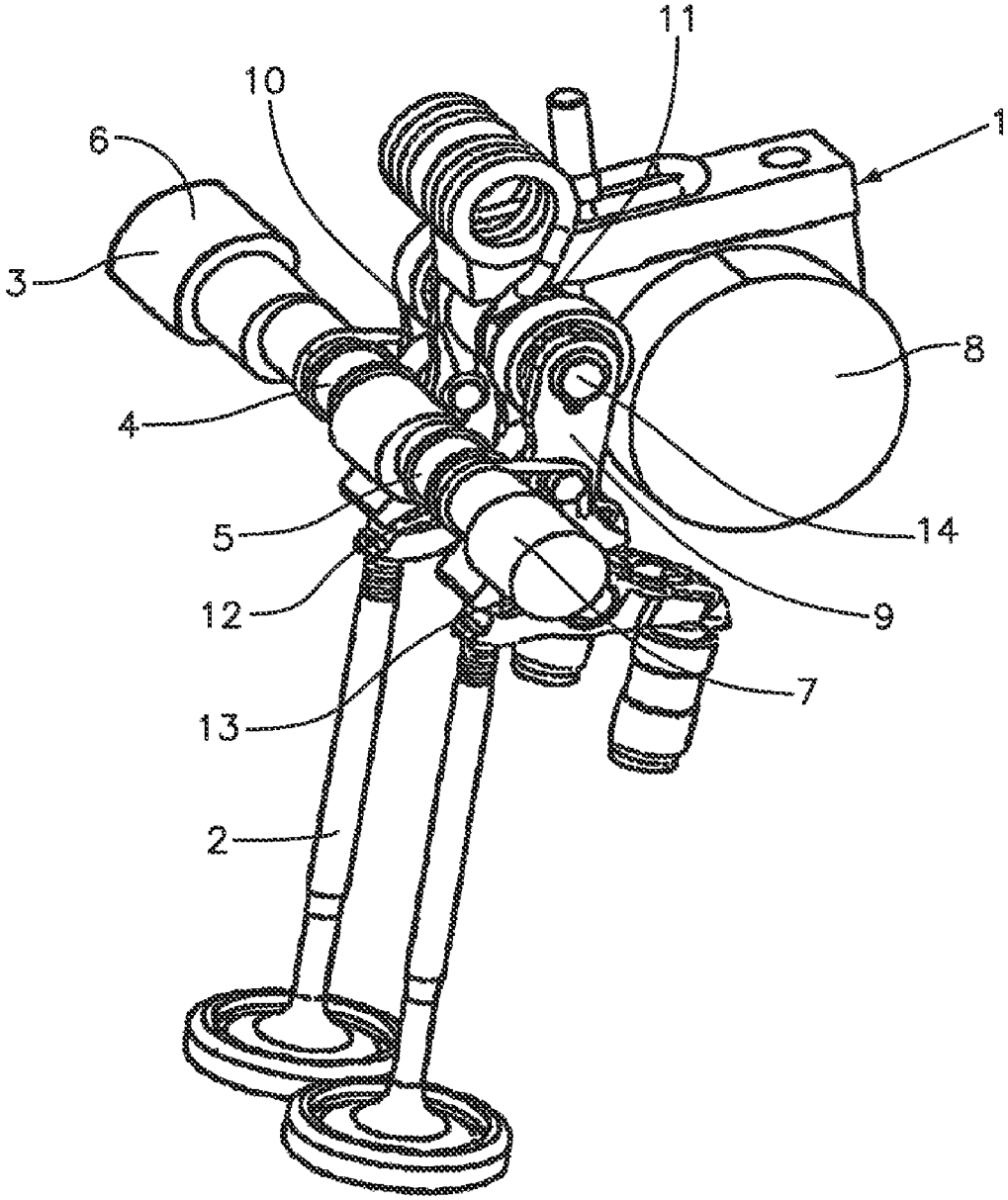

| | | | | |
|---|---|---|---|---|
| 5,645,020 | A | 7/1997 | Yamada | |
| 6,098,581 | A | 8/2000 | Buck et al. | |
| 7,603,973 | B2 * | 10/2009 | Flierl et al. | 123/90.16 |
| 2002/0162522 | A1 | 11/2002 | Morrn | |
| 2004/0144347 | A1 | 7/2004 | Schleusener et al. | |

FOREIGN PATENT DOCUMENTS

| | | |
|---|---|---|
| DE | 4223172 | 8/1993 |
| DE | 4223173 | 1/1994 |
| DE | 4326331 | 2/1995 |
| DE | 4413406 | 10/1995 |
| DE | 19548389 | 6/1997 |
| DE | 19815112 | 10/1998 |
| DE | 19807675 | 8/1999 |
| DE | 10123186 | 11/2002 |
| DE | 10137072 | 2/2003 |
| DE | 10140635 | 4/2003 |
| EP | 0111768 | 6/1984 |
| EP | 1096115 | 11/1999 |
| EP | 1234968 | 1/2002 |
| GB | 190906650 | 10/1909 |
| JP | 59068508 | 4/1984 |

* cited by examiner

VARIABLE VALVE LIFT DEVICE FOR THE LIFT ADJUSTMENT OF GAS-EXCHANGE VALVES OF AN INTERNAL COMBUSTION ENGINE

The invention relates to a variable valve lift device for the lift adjustment of gas-exchange valves of an internal combustion engine.

An adjustment device for the lift adjustment of a gas-exchange valve of an internal combustion engine is known from the DE 195 48 389 A1 and the DE 101 23 186 A1, whereby the adjustment device in the DE 195 48 389 A1 shows for the setting or alignment of the valve lift of a gas-exchange valve an eccentric shaft, which is bedded rotatable within a cylinder head with an electric engine, which is driven by a worm gear with an engine shaft, which are positively connected via the gear with the eccentric shaft, and a control unit, which controls the electric engine. The setting of an adjustable lift by means of an eccentric is also known from the prior art. The forces being necessary for the distortion of the eccentric and for the support of an eccentric in an adjusted valve lift position respond directly to the energy input and therewith to the consumption of an internal combustion engine with a variable valve lift. Furthermore, it is known adjusting an eccentric shaft by means of an electric-hydraulic drive, which, however, is complex, and which cannot adjust fast enough the eccentric shaft in all working conditions of the internal combustion engine. The setting respectively the alignment of the valve lift of a fully variable valve operating mechanism with a parallelogram is known from the DE 101 40 635.5. However, a parallelogram is constructed from many individual components, an adjustment bar, several guides and a traction bar with several joints. Therewith, based on the component tolerances and the necessary joint tolerances, high cost requirements arise.

In general, in a fully variable valve operating mechanism, the valve lift for the setting of the load is controlled. In multi-cylinder internal combustion engines, the valve lift for the control of the idle-running speed is adjusted in the range of few tenth parts of millimeters. Thereby, in this load point, the valve lift between the cylinders may differ only for a value of approximately 10%, because otherwise as a result of the different loads of the cylinders, the whole engine is excited to an incorrect shaking, what, in a vehicle, results in a comfort loss, which cannot be accepted.

It is the object of the present invention producing a valve lift device for the lift adjustment of the gas-exchange valves of an internal combustion engine with adjustment forces and holding forces being as low as possible, independently from, whether said holding forces and adjustment forces are applied mechanically, hydraulically or electrically, with an adjustment of the valve lift being as cost-efficient as possible, and with maximum accuracy of the setting respectively adjustment of the valve lift to be taken between the individual cylinders of a multi-cylinder internal combustion engine, and, moreover, achieving the control possibility of the valve lift of the valves of an internal combustion engine with several cylinders within smallest tolerance.

In one embodiment, the valve lift device for the lift adjustment of the gas-exchange valves of an internal combustion engine has a rotatable eccentric shaft, which consists of several eccentrics, and whereby all possible contours of the eccentrics are positioned within a circle, which is formed by means of the bearing diameters of the eccentric shaft.

Advantageously, it is provided that the eccentric shaft is pluggable through a through-going drilling in the cylinder head material, and is bedded directly within the through-going drilling in the cylinder head, and that the eccentric shaft is mountable as a pluggable eccentric shaft from one of the front walls of the cylinder head.

An advantageous alternative is seen therein that the eccentric shaft is bedded in a separate housing, which is connected with the cylinder head, whereby in the housing also a camshaft is bedded, or that in the housing the eccentric shaft, the rocker levers, the camshaft and a slotted link are bedded as pre-mounted unit.

Advantageously, the eccentric shaft is bedded by means of anti-friction bearings within the cylinder head.

Preferred embodiments of the valve lift device consist therein that the eccentric contour can be formed as an arbitrary contour, in particular as circle, and is limited by the external diameters of the bearing of the eccentric shaft, that the maximum diameter of the eccentric shaft is provided as bearing of the eccentric shaft in particular within the cylinder head, and is bedded in the shortest distance to the rocker point and setting point of the rocker levers, and that the eccentric shaft is arranged parallelly to the camshaft.

Furthermore, besides a mechanically adjusting of the valve lift of the valves, it is provided as alternative that the eccentric shaft is hydraulically adjustable, or that the eccentric shaft is adjustable by means of an electric engine, which is provided in an aligned manner with the camshaft or with the eccentric shaft, whereby the axis of the electric engine is provided parallelly to the axis of the camshaft or parallelly to the axis of the eccentric shaft.

A preferred embodiment is seen therein that the eccentrics, in case of an arrangement with two or several inlet valves or outlet valves, are arranged towards each other distortedly at an angle $\alpha$, so that in a rotational position of the eccentric shaft different valve lifts result for the valves.

A particular preferred embodiment is seen therein that in a cylinder head for the actuation of inlet valves and outlet valves, several eccentric shafts are provided, whereby the eccentric shafts of several inlet valves or outlet valves differ in the contour of the eccentrics.

Furthermore, it is advantageously provided that the valves of contiguous cylinders are to be actuated with different eccentric contours by means of the rocker levers, and that camshaft contours for the valves, which belong to one cylinder, are designed differently.

A preferred embodiment is seen therein that work contours of the rocker levers, which are in contact with the eccentric shaft, form a flat plane, or that the work contours of the rocker levers, which are in contact with the eccentric shaft, form a concave or convex plane.

As the case may be, a preferred embodiment is seen therein, that the eccentrics are in contact with a bedded roller of the rocker levers.

Additionally, it may be provided that the work contour of the rocker lever is designed differently from the work contour of the second rocker lever, which are directly connected with each other by means of one axis.

The essential feature of the novel design of the eccentric shaft is that therewith a control possibility of the valve lift of the valves of an internal combustion engine with one or several inlet valves or outlet valves is obtained within smallest tolerances, using low adjustment forces and holding forces, independently, whether said holding forces and adjustment forces are applied mechanically, hydraulically, or electrically, and with maximum accuracy of the setting respectively adjustment of the valve lift to be taken between the individual cylinders of a multi-cylinder internal combustion engine.

Furthermore, the present invention relates to an actuator technology for combustion engines with a variable valve control system for the lift adjustment of the gas-exchange valves of an internal combustion engine, with a rotatable eccentric shaft, which is bedded within a cylinder head, for the adjustment of the valve lift of a gas-exchange valve, whereby an exchangeable, differently designed actuator, which is arranged within a housing, is arranged bottom-sided at an eccentric shaft, which is bedded in a cylinder head, for the distortion thereof, and which is mounted at the cylinder head by means of mounting elements, which are provided at the housing, whereby by means of a connecting element, which is provided on the eccentric shaft, a transfer of the actuator motion to the distortion motion of the eccentric takes place, and whereby by exchange of different actuators with the connecting element for the eccentric shaft a change-over from a step-less variable valve lift adjustment to a stepwise change of the valve lift can be carried out without changes at the cylinder head. The connecting element is provided as independent component or as constituent part of the eccentric shaft, whereby the independent connecting element is exchangeable together with the actuator. The simple change-over of the change of the valve lift of the gas-exchange valves of an internal combustion engine, which is achieved by means of the exchange of different actuators, has the advantage, that a cost-effective, unitary modular concept for a cylinder head is possible, because only the connection of the actuator and the clutch between actuator and eccentric shaft, which is bedded within the cylinder head, has to be changed, and therewith the capital investments for the manufacture of the cylinder head are low for different valve lift adjustments. Because, alternatively, also from two to four valve lift positions can be realized, improvements are possible for an engine with respect to performance and torque compared with an engine with determined operation periods for the valve lift.

It is advantageous that the exchangeable actuators show either a hydraulic adjustment element, or are formed alternatively as electric engine, which acts directly on the eccentric shaft, or is formed as lift magnet.

A possible and, as the case may be, preferred embodiment is seen therein that the electric engine or the lift magnet are provided within a black box, which has at its front wall at the housing mounting elements for the mounting at the cylinder head, which are arranged oppositely towards each other.

Furthermore, it is advantageously provided, that in case of a change-over from a step-less variable valve lift adjustment to a stepwise change of the valve lift, the eccentric shaft is identical, or that for particular applications also the eccentric shaft is modular and is exchangeable independently from the design of the actuator.

A preferred alternative is seen therein that for the change-over from a step-less variable valve lift adjustment to a stepwise change of the valve lift, the corresponding connecting element, which is formed as clutch, is exchangeable.

Preferably, it is provided that the actuator is connected with the eccentric shaft either on the front wall or on the backside of the cylinder head.

Alternatively, it is also provided that for different embodiments the actuator is not arranged directly aligned with the eccentric shaft, however, that between actuator and eccentric shaft an intermediate gearbox is provided.

An advantageous embodiment is seen therein that for a step-less variable valve lift adjustment, the valve lift is detected by means of a sensor, which is arranged at the cylinder head, for a feed back signal of the position of the valve lift of the gas-exchange valves.

A preferred embodiment is seen therein that the change-over of the gas-exchange valves from a step-less variable valve lift adjustment to a stepwise change of the valve lift for inlet valves and outlet valves, which is carried out by means of the exchange of the actuators, is provided in a way that at both valve sides a fully variable or stepwise change or on one valve side a stepwise and on the other valve side a fully variable change of the valve lift is provided for the gas-exchange valves, respectively.

Another advantageous embodiment is seen therein that the actuator with a hydraulic adjustment element, which is provided for the gas-exchange valves at the inlet valve side and outlet valve side, has a rotor, which takes different switching positions.

Advantageously, the actuator with the hydraulic adjustment element is formed from plastics, wherein the rotor thereof shows at least one rotor wing.

An embodiment, which is favorable with respect to production technique, is seen therein, that the actuator with the hydraulic adjustment element is fed with hydraulic oil pressure from the engine circulation.

Also, it is advantageously provided that a magnetic valve for the actuation of the actuator with the hydraulic adjustment element, which is in particular formed as lift magnet, is fixed at the cylinder head. Finally, it can also be advantageous that the magnetic valve for the actuation of the actuator with the hydraulic adjustment element is positioned within the actuator, preferably coaxially to the actuator center line.

It is essential for the new actuator characteristic, that by means of the exchange of different actuators a change-over of the change of the valve lift of the gas-exchange valves of an internal combustion engine from a step-less variable valve lift adjustment to a stepwise change of the valve lift without change at the cylinder head is obtained for different engines.

Another advantageous embodiment of the present invention relates to a device for the variable valve control or valve adjustment in particular of gas-exchange valves of an internal combustion engine with a camshaft adjustment device, a rotatable, preferably within a cylinder head bedded eccentric shaft, with a cam contour per gas-exchange valve, for the controlling or adjustment of the valve lift of at least one gas-exchange valve, as well as an actuator, which is provided for the distortion of the eccentric shaft at the bottom thereof. The eccentric shaft acts on at least one rocker lever, whose motion sequence can be influenced by means of distortion of the eccentric shaft, whereby the rocker lever is engaged into a camshaft and a cam follower, which acts on a gas-exchange valve.

In principle, all adjustment devices, which are known to the one skilled in the art, can be applied as camshaft adjustment devices. It is preferred applying camshaft adjustment devices according to the wing cell principle, as they are known, for instance, from the DE 199 43 833 A1, or camshaft adjustment devices, which work by means of a piston, which is axially shiftable on a beveled gear tooth tailing, as, for example, described in U.S. Pat. No. 5,031,583.

According to the invention, the adjustment of the camshaft can be carried out by means of the camshaft adjustment device in a stepwise or step-less manner.

Thereby, the actuator is provided exchangeable and differently formed, and is arranged bottom-sided at an eccentric shaft for the distortion thereof, which is bedded within a cylinder head, and is mounted by means of two mounting elements, which are provided at the housing, at a cylinder head.

By means of a clutch, which is provided at the eccentric shaft, a transfer of the actuator motion to the rotary motion of the eccentric shaft takes place, whereby by means of exchange of different actuators with the corresponding clutches for the eccentric shaft, a change-over from a step-less variable valve lift adjustment to a stepwise change of the valve lift can be carried out without changes at the cylinder head. The simple change-over of the change of the valve lift of the gas-exchange valves of an internal combustion engine, which is achieved by means of the exchange of different actuators, has the advantage that a cost-effective, unitary modular cylinder head concept is possible, because only the connection of the actuator and the clutch between actuator and eccentric shaft, which is bedded within the cylinder head, has to be changed, and therewith the capital investments for the manufacture of the cylinder head are low for different valve lift adjustments. Because, alternatively, also from two to four valve lift positions can be realized, improvements for an engine concerning performance and torque are possible compared with an engine with determined control periods for the valve lift. Furthermore, for each gas-exchange valve only one cam on the eccentric shaft is necessary for the valve lift adjustment, what contributes to the decrease of manufacturing costs compared with known multi-cam systems.

The device according to the invention can be run with an actuator for the step-less adjustable valve lift adjustment or with an actuator for stepwise change of the valve lift or with an actuator for the step-less adjustable valve lift adjustment and stepwise change of the valve lift. Thereby, the valve lifts can be changed in a step-less manner and/or stepwise manner by means of a cam per valve dependent on the respective requirement. In case of internal combustion engines with low requirements to the valve adjustability, where the load control is not carried out by means of the fully variable change of the valve lifts respectively the valve lift contours, and where therewith considerable advantages in system manufacturing costs arise, valve lifts respectively valve lift contours with intermediate positions are sufficient, as they can be achieved by means of stepwise change of the valve lift.

It is advantageous that the exchangeable actuators have either a hydraulic adjustment element, or, alternatively, are formed as electric engine, which acts directly on the eccentric shaft or as lift magnet.

A possible, and as the case may be, preferred embodiment is seen therein that the electric engine or the lift magnet are provided within a black box, which provides at its front wall at the housing mounting elements for the mounting at the cylinder head, which are arranged oppositely towards each other.

Furthermore, it is advantageously provided, that in case of a change-over from a step-less variable valve lift adjustment to a stepwise change of the valve lift, the eccentric shaft is identical.

A preferred alternative is seen therein that for the change-over from a step-less variable valve lift adjustment to a stepwise change of the valve lift, the corresponding clutch is exchangeable.

Preferably, it is provided that the actuator is connected with the eccentric shaft either on the front wall or on the backside of the cylinder head.

Alternatively, it is also provided, that for different embodiments the actuator is not arranged directly aligned with the eccentric shaft, however, that between actuator and eccentric shaft an intermediate gearbox is provided.

An advantageous embodiment is seen therein that for a step-less variable valve lift adjustment, the valve lift is detected by means of a sensor, which is arranged at the cylinder head, with a feed back signal of the position of the valve lift of the gas-exchange valves.

A preferred embodiment is seen therein that the change-over of the gas-exchange valves from a step-less variable valve lift adjustment to a stepwise change of the valve lift for inlet valves and outlet valves, which is carried out by means of the exchange of the actuators, is provided in such a way that, respectively, at both valve sides a fully variable, partially fully variable, stepwise change or that on both valve sides a stepwise change of the valve lift is provided for the gas-exchange valves.

Another advantageous embodiment is seen therein that the actuator with a hydraulic adjustment element, which is provided for the gas-exchange valves at the inlet valve side and outlet valve side, has a rotor, which takes different switching positions.

Advantageously, the actuator with the hydraulic adjustment element is formed from plastics, wherein the rotor thereof shows at least one rotor wing.

An embodiment, which is favorable with respect to production technique, is seen therein, that the actuator with the hydraulic adjustment element is fed with hydraulic oil pressure from the engine circulation.

Likewise, it is advantageously provided that a magnetic valve for the actuation of the actuator with the hydraulic adjustment element, which is in particular formed as lift magnet, is fixed at the cylinder head.

Finally, it can be advantageous that the magnetic valve for the actuation of the actuator with the hydraulic adjustment element is positioned within the actuator, preferably coaxially to the actuator center line.

The present invention also relates to an internal combustion engine, which shows at least one of the devices according to the invention.

Furthermore, the present invention relates to internal combustion engines with two or more camshafts, which show at least at one of the camshafts a device according to the invention, and at the further camshafts only a stepwise or step-less cam adjustment device, or where each camshaft shows a device according to the invention.

In principle, for internal combustion engines with cylinder head with two or more camshafts any combination of the device according to the invention with individual or several camshafts is possible. Thereby, it is preferred providing the device according to the invention at the camshaft, which controls the inlet valves, whereby the camshaft for the outlet valves merely provide one or no camshaft adjustment device.

It is essential for the device according to the invention that by means of the exchange of different actuators a change-over of the change of the valve lift of the gas-exchange valves of an internal combustion engine from a step-less variable valve lift adjustment to a stepwise change of the valve lift without change at the cylinder head is achieved for different engines, what results with the simultaneous adjustability of the camshaft to an even better interference and therewith to a further performance optimization of an internal combustion engine with simultaneous fuel reduction.

Another preferred embodiment of the present invention relates to a device for the variable valve lift adjustment, in particular of gas-exchange valves of an internal combustion engine with one or several arrangement(s) of the following elements, at least one rocker lever, which runs in a slotted link actuated by means of a camshaft, a means for the actuation of valves, which is engaged with the rocker lever, a spring, which presses the rocker lever against the camshaft, and a multi-part eccentric shaft for the adjustment of the valve lift, which has one or several eccentrics.

In particular, for internal combustion engines with underneath camshaft, the device according to the invention additionally shows between camshaft and rocker lever a push rod, an intermediate lever as well as an adjustment element. In dependence from the construction method of the internal combustion engine respectively the position of the camshaft, also less or more elements or other elements can be provided between camshaft and rocker lever.

The eccentric shaft of the device according to the invention preferably shows a coaxial construction with one eccentric per gas-exchange valve. According to the invention, as gas-exchange valves preferably inlet valves respectively outlet valves are understood, preferably of cylinders of an internal combustion engine.

Furthermore, according to the invention, each part of the eccentric shaft, which can be adjusted individually and independently from the other parts of the eccentric shafts, shows an eccentric, whereby the form of the individual eccentrics can be the same or can be different from each other.

It is preferred adjusting the parts of the eccentric shaft by means of at least one actuator. Preferably, said actuator also shows an adjustment device with coaxial construction. It is preferred applying actuators, for which the adjustment is provided by means of electric engines or hydraulic angle adjustment devices. In particular in using a control, additionally, preferably different, sensors and a suitable control technique are supplied. Thereby, a fast response behavior of the control is important, so that for instance an adjustment of the valve lift from zero-lift to maximum lift in, preferably less than 300 ms, can take place. Thereby, the parts of the eccentric shaft are distorted preferably in an angle of approximately 120°.

Different embodiments of suitable actuators for the stepless and/or stepwise adjustment of the individual eccentric shaft parts are described in the DE 103 52 677.1, the content of which is fully incorporated into the context of the present application. By means of a suitable actuator, it is therewith possible, for instance in case of two inlet valves per cylinder, to adjust the valve lift of said valves with a multi-part eccentric shaft in such a manner that the valve lift of a valve and the valve lift of the other valve is stepwise adjustable. This solution is also conceivable for more than two inlet valves respectively outlet valves per cylinder, whereby the valve lift of each individual valve can be adjusted individually and independently from other valves, in particular of similar valves of a cylinder. In an extreme case, thereby individual valves or groups of valves can be run in zero-lift, whereby the switch-off of individual cylinders is possible.

Advantageously, when using the device according to the invention in a cylinder head for the actuation of inlet valves and outlet valves, several eccentric shafts can be provided. It is also conceivable assigning to each inlet valve or outlet valve an eccentric shaft of its own.

It is also possible providing in the device according to the invention for valves of contiguous cylinders different eccentric forms. Here, for eccentric form, preferably the eccentric contour is understood, which contacts the rocker lever for the adjustment of the valve lift.

Furthermore, the present invention relates to a process for the variable valve lift adjustment, in particular of gas-exchange valves of an internal combustion engine, by using a device according to the invention, in which each individual eccentric can be adjusted individually and independently from the other eccentrics of the eccentric shaft. In the process according to the invention, the individual parts of the eccentric shaft are preferably adjusted with the corresponding eccentrics by means of one or several actuator(s).

Finally, the present invention also relates to an internal combustion engine, which shows at least one device according to the invention.

Preferably, all possible contours of the eccentrics of the rotatable eccentric shafts are positioned within a circle, which is formed by means of the bearing diameter of the eccentric shaft. The multi-part eccentric shaft is therewith pluggable through a through-going drilling in the cylinder head material, and is preferably directly bedded in the through-going drilling within the cylinder head, whereby the eccentric shaft is mountable as pluggable eccentric shaft from one of the front walls of the cylinder head.

Another advantageous alternative is seen therein that the eccentric shaft is bedded in a separate housing, which is connected with a cylinder head, whereby in the housing also a camshaft can be bedded, or that in the housing the eccentric shaft, the rocker levers, the camshaft and a slotted link are bedded as pre-mounted unit.

It is preferred bedding the eccentric shaft by means of anti-friction bearings within the cylinder head. However, it is possible applying any alternative bearings, which are suited for said bedding, which are known to the one skilled in the art.

Further preferred embodiments of the device according to the invention consist therein that the eccentric contour is formed as arbitrary contour, in particular as circle, and is limited by means of the external diameters of the bearing of the eccentric shaft, so that the maximum diameter of the eccentric shaft is provided as bearing of the eccentric shaft, in particular within the cylinder head, and is bedded in the shortest distance to the rocker point and adjustment point of the rocker levers, and that the eccentric shaft is arranged preferably parallelly to the camshaft.

Furthermore, besides a mechanic adjustment of the valve lift of the valves, it is preferred as an alternative that the eccentric shaft is adjustable, for instance by means of adjustment devices, hydraulically or by means of an electric engine, which preferably is provided in an aligned manner with the camshaft or with the eccentric shaft, whereby the axis of the electric engine is preferably provided parallelly to the axis of the camshaft or parallelly to the axis of the eccentric shaft. Furthermore, between eccentric shaft and actuator respectively adjustment device, suitable clutches can be provided.

A particular preferred embodiment of the device according to the invention is seen therein that within a cylinder head for the actuation of inlet valves and outlet valves, several eccentric shafts are provided, whereby the eccentric shafts of several inlet valves or outlet valves can differ in the contour of the eccentrics.

Furthermore, it may preferably be provided that the valves of contiguous cylinders with different eccentric contours are to be actuated by means of the rocker levers, and that the camshaft contours for the valves, which belong to one cylinder, are formed differently.

Another preferred embodiment is seen therein that the work contours of the rocker levers, which are in contact with the eccentric shaft, for instance form a flat plane, a concave or convex plane. It is also possible that the eccentrics are in contact with a roller, which is bedded within the rocker lever.

Additionally, it can yet be provided that the work contour of a rocker lever is formed differently from the work contour of another rocker lever, which are preferably connected directly by means of one axis.

Inter alia, an essential advantage of the device according to the invention is that a control possibility of the valve lift of the valves of an internal combustion machine with one or several inlet valve(s) or outlet valve(s) is achieved within smallest tolerances, with simultaneous low adjustment forces and holding forces, independently, whether said holding forces and adjustment forces are applied mechanically, hydraulically, or electrically, and with maximum accuracy of the control or adjustment of the valve lift to be taken between the individual cylinders of a multi-cylinder internal combustion engine.

One embodiment of the device according to the invention provides the variable valve lift adjustment, for instance of two inlet valves of a cylinder, by means of two rocker levers, which are connected with each other by means of a jointly axis. It is preferred, providing a roller on said axis between the both rocker levers, which runs in a slotted link. The slotted link is preferably connected in a fixed manner with the cylinder head respectively with a housing respectively is part of the cylinder head respectively is part of the housing. Thereby, the contour of the slotted link can be determined, for instance, by means of a circular arc, with center on the axis of the roller of the roller cam follower (means for actuation of a valve) and a radius, which, for example, is defined in dependence from one or several diameters of the rollers of the rocker lever.

The two rocker levers, which are driven by the camshaft, thereby move by means of a rocker motion around the eccentrics of the eccentric shaft. Thereby, with the device according to the invention, it is possible adjusting the rocker point respectively the center of rotation of each individual rocker lever by means of the eccentric of the eccentric shaft, which is in connection with the rocker lever, individually and independently from the one contiguous or from the contiguous rocker lever(s) by means of rotation of the eccentric shaft. Thereby, the adjustable lift of the eccentric shaft is preferably approximately 3.5 mm, and is suitable, thereby adjusting the valve lift preferably from 0 to 10 mm.

With respect to the rotary motion of the rocker lever around the eccentric shaft, it is important distributing the rocker lever mass extremely good, and balancing in such a manner that the contact forces, which act on the eccentric shaft, are low, and also do not increase with increasing rotational speed of the internal combustion engine.

For instance, this can be supported by suitable construction of the rocker levers, whereby the rocker levers are not made from full material, but have recesses, which reduce the mass or also the size. Furthermore, the center of rotation of the rocker lever should be close to or should be in the mass center of the rocker lever.

Said fully variable and independent possibility of the adjustment of the valve lift, in particular of two inlet valves of a cylinder, wins importance, in particular for internal combustion engines with four valves per cylinder, preferably two inlet valves and two outlet valves, because the valve lift and the valve opening time for each individual valve respectively for each pair of valves (pair of inlet valves respectively pair of outlet valves) can be adjusted individually. In an extreme case, each valve can be run individually in the zero-lift, what can result in that, for instance, the related cylinder is run only with one inlet valve or one outlet valve. The valve lift and the valve opening time preferably are determined by means of the cam contour form of the camshaft and the form of the work curve of the rocker lever. In the result, this can for instance comply with a valve opening time in the idle-running of a crank shaft angle of approximately 90° for a valve lift of only 0.25 mm whereby a crank shaft angle of approximately 320° is possible for full valve lift, whereby additionally a good idle-running quality is achieved.

In another preferred embodiment, the internal combustion engine, which has a device according to the invention, is suitable, for instance running with rotational speeds up to 8.500 revolutions per minute. In this embodiment, the valve opening time and the valve lift can be controlled or adjusted independently fully variable for each valve. If, for instance, the internal combustion engine is run in the idle-running, the valve lift is approximately 0.3 mm and the valve opening time thereby corresponds to a crank shaft angle of approximately 90°. For full-load, the valve lift corresponds, for example, to 9 mm, whereby the valve is opened with a crank shaft angle of 320°.

In an also preferred embodiment, the adjustment of zero-lift to maximum lift of the valve takes places at a rotation of the eccentric shaft of approximately 120°. Thereby, the maximum valve holding moment and valve adjustment moment of the eccentric shaft is approximately 4 Nm, measured for two valves.

In another preferred embodiment, the valve opening time can be varied together with the valve lift in connection with one or several air inlet system(s) with fully variably adjustable length, what results in a clearly torque improvement. The device according to the invention can also be combined with systems for variable cylinder compression within internal combustion engines.

Another advantageous embodiment of the present invention relates to a variable valve lift control system for a combustion engine with underneath camshaft for the adjustment of a valve lift and an opening time of at least one inlet valve and/or outlet valve load-dependently and rotational speed-dependently as well as for the switch-off of individual cylinders of an internal combustion engine, wherein rocker levers and swing arms, which are driven by means of cams of a camshaft, actuate by means of the engagement into further rocker levers or swing arms the inlet valve and outlet valve, whereby an underneath camshaft drives by means of a push rod via a hydraulic valve clearance adjustment element a rocker lever, which has a curve contour, which runs on a roller of an intermediate lever, which is movable by means of two rollers, which are arranged on one axis, in slotted links, which are connected in a fixed manner with a cylinder head, whereby the intermediate lever supports with an engagement area (contour) at an adjustment bar, which is conducted in a housing, and which rolls with a work curve on a roller of a cam follower, and whereby the cam follower acts on a hydraulic adjustment element and a valve of a combustion engine by means of engagement areas, which are provided bottom-sided, respectively.

It is preferred adjusting by means of a shift of the adjustment bar the region of the work curve of the intermediate lever, which is used with the roller of the cam follower in one rotation of the camshaft. Therewith, a valve lift and dependent thereof the opening time of the inlet valve and outlet valve is adjusted.

Thereby that inter alia the work curve of the rocker level determines the opening characteristic of the valve, the work curve is in particular constructed from several individual regions, in such a manner that a first region determines a zero-lift, which is defined by means of a circular arc around the center of the roller of the intermediate lever, following at it a second region, which defines the opening ramp, and following at it a part-lift region and a full-lift region, whereby the individual regions are connected with each other by means of transition radii, and that over the total curve region a spline is laid in order to connect the curve regions with each other without shock.

Furthermore, it is preferred that by means of an embossment of the camshaft, by means of the curve contour of the rocker lever and by means of the work curve of the intermediate lever, the opening characteristic of the valve is determinable.

A preferred embodiment is seen therein that the work curve, which as yet was arranged on the intermediate lever in a known manner, is now arranged on the cam follower, and that the previous roller of the cam follower is constituent part of the intermediate lever.

In another embodiment, the rocker lever has an additional roller, which is in direct connection with the roller of the intermediate lever, which runs at the slotted link.

A likewise advantageous embodiment is seen therein that the intermediate lever is conducted axially through a leg spring or through a slotted link with a lateral line.

Another preferred embodiment is seen therein that the intermediate lever supports with a circular contour at the adjustment bar, whereby said contour can also support on a roller, which is bedded in a friction bearing or an anti-friction bearing.

Another likewise advantageous embodiment is that the adjustment bar shows a contact contour, for example in a shape of a circular arc, concave, ascending and sloping, because by means of the form of the contact contour of the adjustment bar inter alia also the acceleration behavior of the valve of the internal combustion engine is influenced.

In one embodiment of an internal combustion engine with several inlet valves and outlet valves, the valves with different valve lifts and therewith coupled with different opening times, are thereby adjusted that by means of several adjustment bars, which are adjustable by means of individual actuators, the corresponding set value is calculated by means of a process-controlled engine characteristic or by means of a program-controlled model.

A major advantage of said variable valve lift control system of Diesel engines consists therein that by means of an individual control of the valve lift of, for instance, two inlet valves, the twist of the in-cylinder flow can be adjusted, and the major advantage of Otto engines consists therein that, for instance, in case of two inlet valves, the in-cylinder flow can be adjusted in a manner that the combination of a fuel injection valve, which injects the fuel directly into the combustion chamber, is facilitated in broad operating ranges. The combination of a fuel inlet valve, which injects directly, with a valve operating mechanism with underneath camshaft facilitates new possibilities in the arrangement of the fuel injection valve within the combustion chamber, because a limitation by means of an overhead camshaft is not existent.

Advantageous alternatives of the embodiments are seen therein that either the adjustment element is omitted or that only one valve clearance adjustment element is applied.

Furthermore, it is also preferred providing the intermediate lever formed from aluminum or from a titanium alloy.

Further advantageous embodiments are seen therein that either all rollers are bedded in anti-friction bearings, or that the rollers are bedded in anti-friction bearings and friction bearings, and that the rocker level is bedded in an anti-friction bearing or a friction bearing.

It is essential for the new variable valve lift control system for a combustion engine with underneath camshaft that thereby the valve lift of one or more inlet valves and/or outlet valves can be adjusted load-dependently and rotational speed-dependently, that simultaneously coupled with the valve lift also the opening time of the valves is adjusted, and that additionally by means of the adjustment of a zero-lift of the valves, individual cylinders of an internal combustion engine can be shut down. It is achieved by means of this manner that the fuel consumption is reduced.

The present invention furthermore relates to a preferably bifurcate rocker lever with a determined contour, a work curve and at least one roller. Said rocker lever can be preferably applied alternatively or in combination with rocker levers, which have in place of the determined contour a roller. In doing without the roller and the providing of a determined contour in the place thereof have several advantages. A determined contour in place of a roller decreases the weight of the rocker lever and increases the rigidity thereof. The economy of a roller inclusively the axis, bearing and manufacturing costs, which are associated therewith, further results in overall lower costs of the rocker lever. However, the much more remarkable advantage is the increase of the accuracy of the function of the device according to the invention for the variable valve lift adjustment or valve lift control system. If a determined contour is provided in place of the roller, then the tolerance of a drilling is omitted, which is necessary for the roller axis as well as the tolerance for an appropriate bearing of the roller. Furthermore, for instance, the contour can be processed or produced in a clamping, what saves manufacture time as well as manufacture costs. Finally, with a rocker lever with determined contour, a lower high loading pressure is achieved in the rocker lever-adjustment element-contact: for example, as adjustment element an eccentric shaft or an adjustment bar is applied. In principle, the form or shape of the contour is freely selectable, and can show besides flat slides also convex or concave slides or combinations thereof. Thereby, also ball-shaped bended planes are conceivable, in order to form the contact form of line contact and punctual contact variable.

The device according to the invention for the variable adjustment of the valve lift can be applied in internal combustion engines with overhead camshaft as well as in internal combustion engines with underneath camshaft, whereby the adjustment of the rocker levers is carried out, for example, by means of one or more adjustment bars or one or more one-piece or multi-part eccentric shafts, which are driven by suitable actuators, as, for example, the actuator technology according to the invention, and whereby an additional adjustment of the camshaft is possible by means of a camshaft adjustment device on the inlet valve side and/or outlet valve side.

In the following, the invention is exemplified by means of a preferred embodiment.

Figure 2:
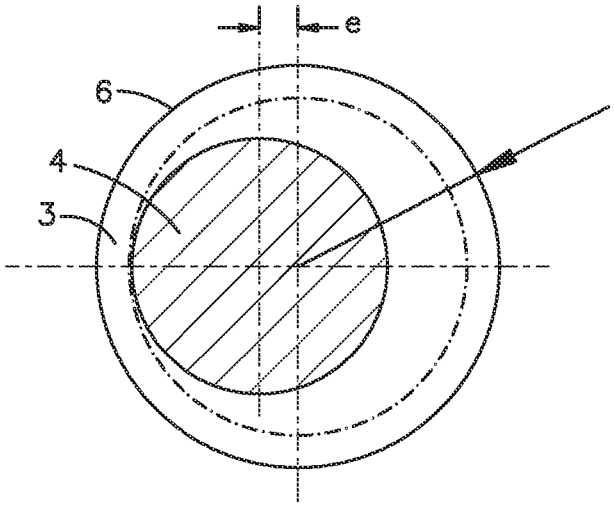
Figure 3:
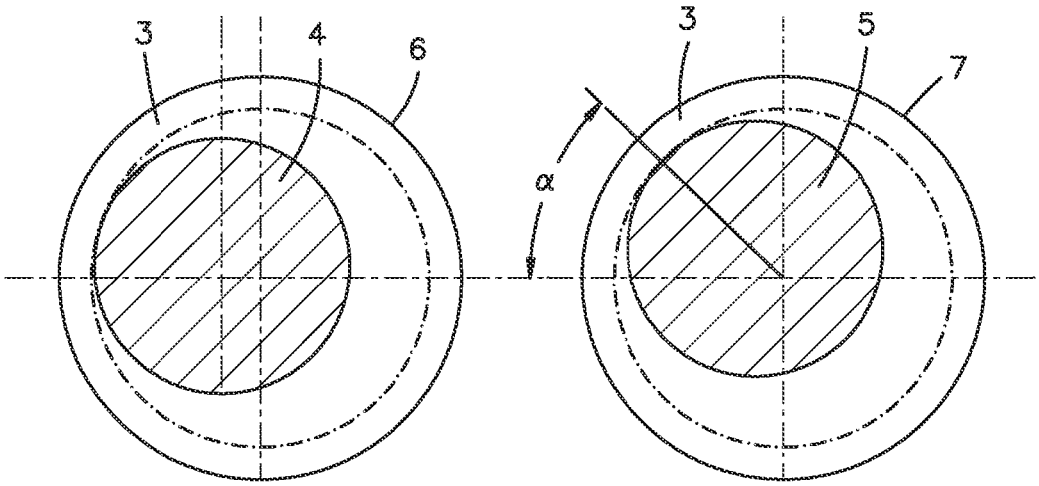
Figure 4:
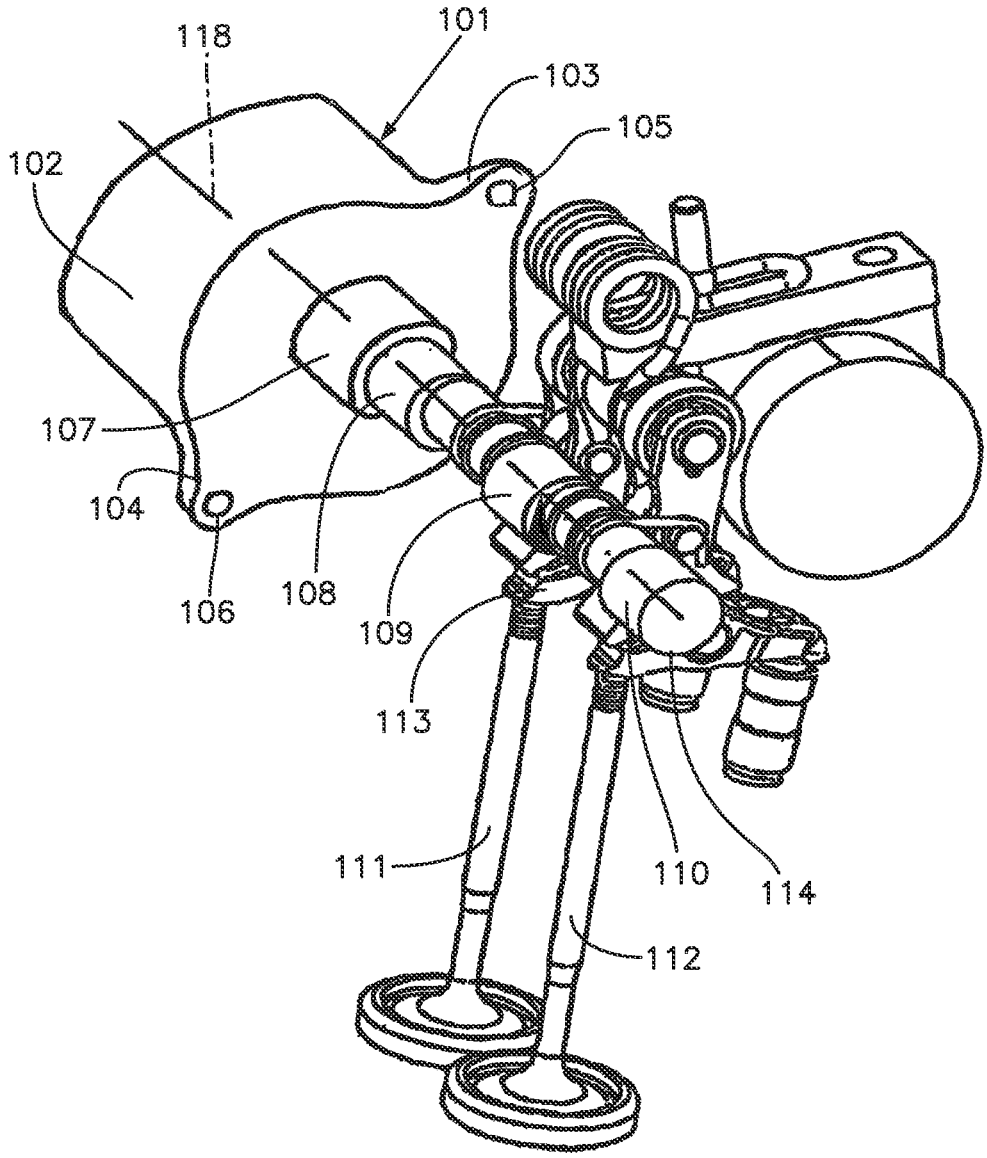
Figure 12:
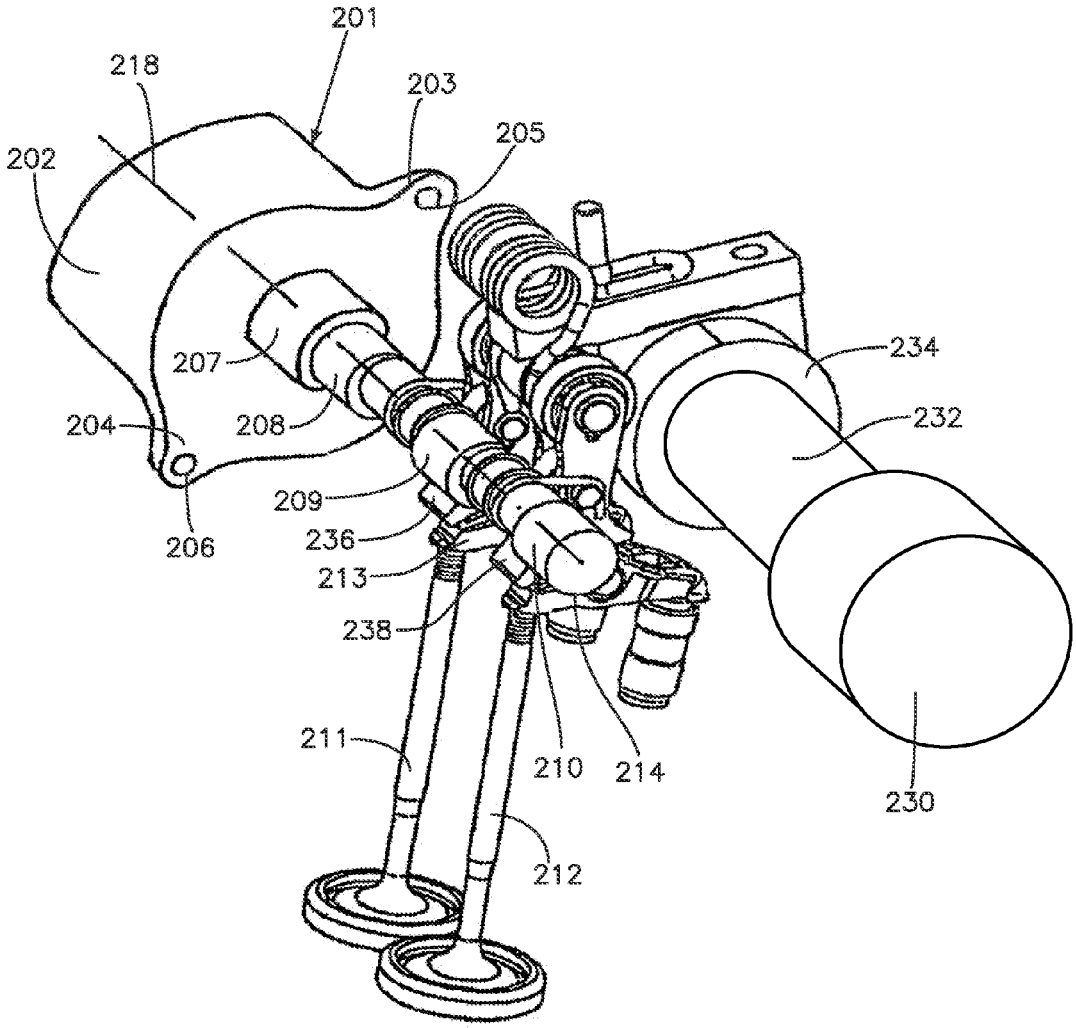
Figure 20:
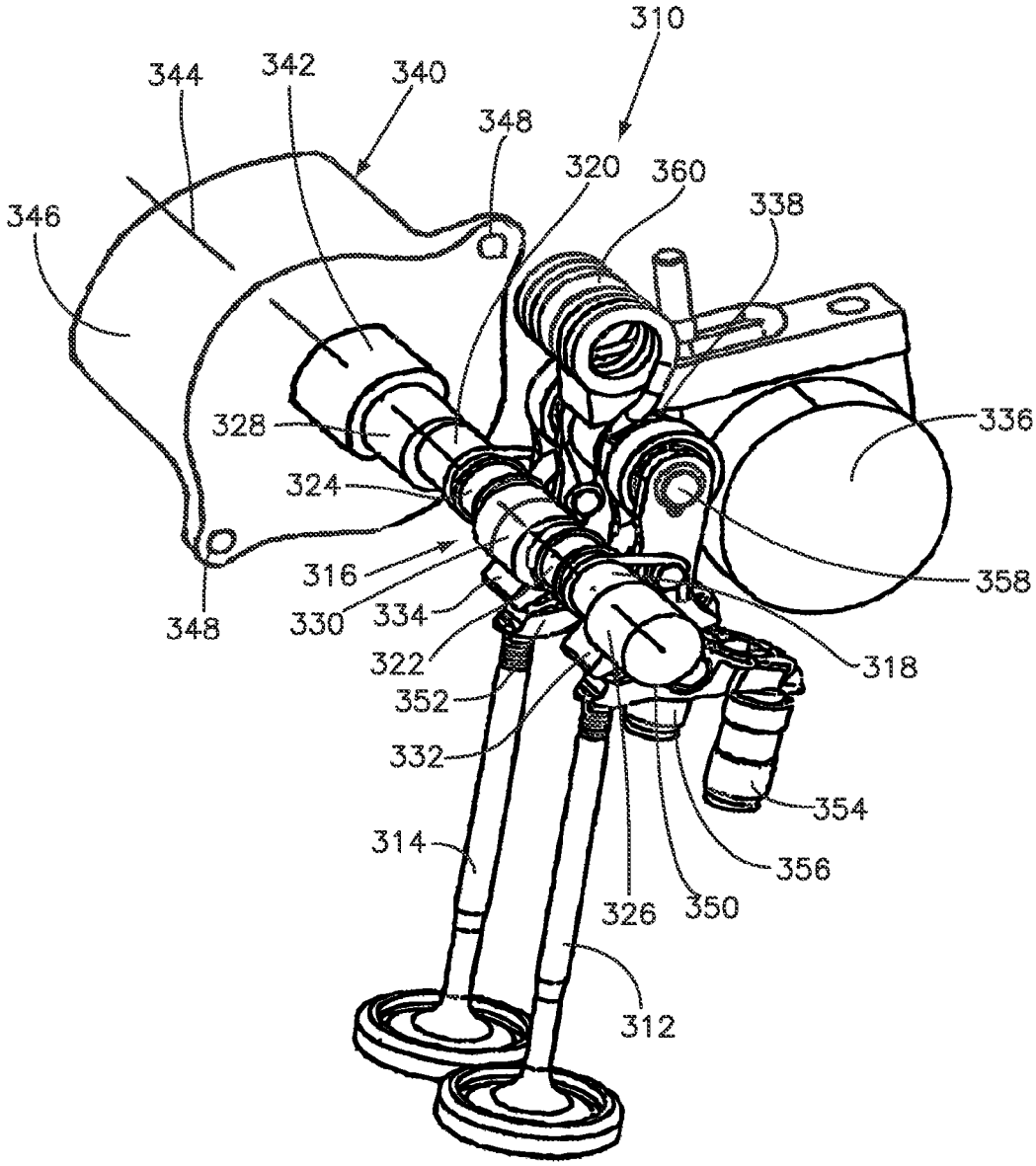
Figure 21:
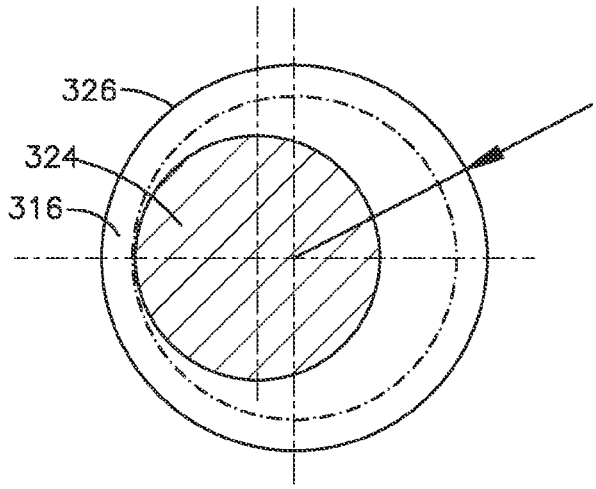
Figure 22:
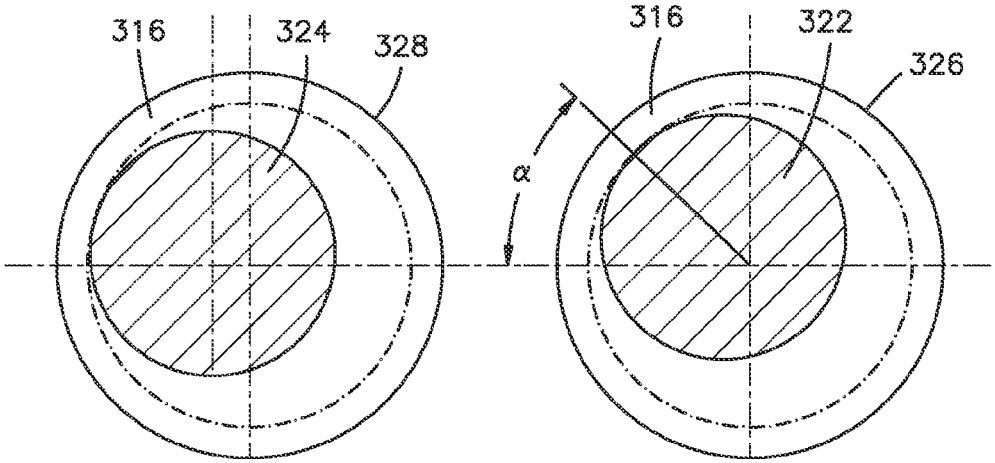
Figure 23:
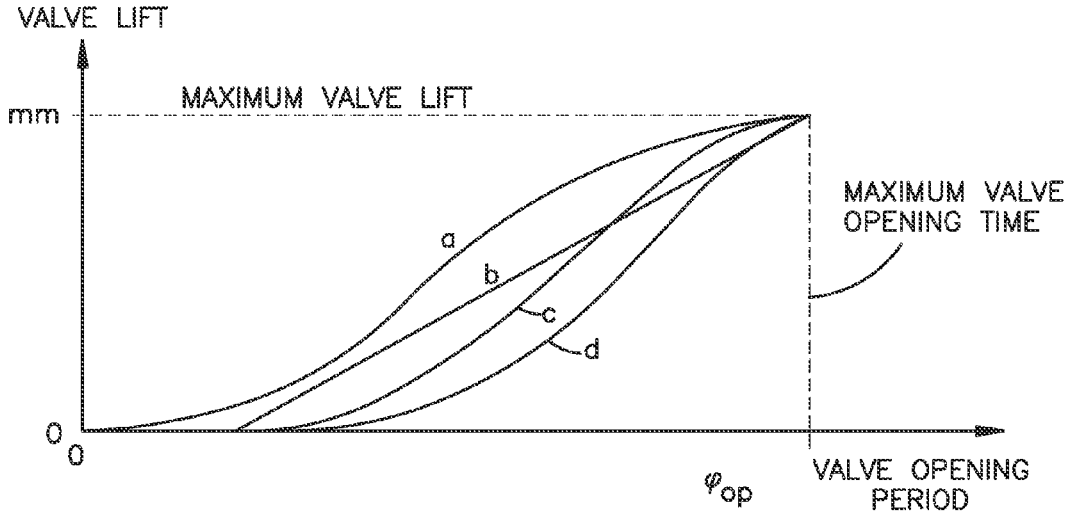
Figure 25:
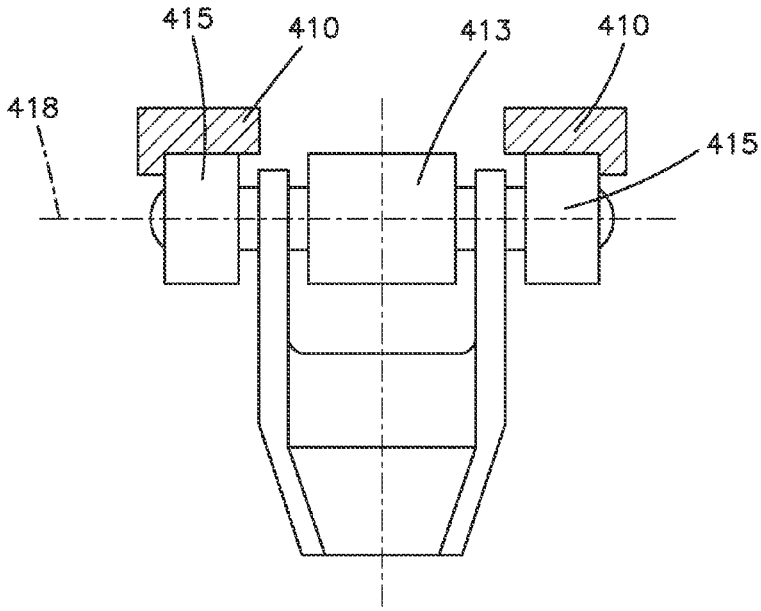
Figure 24:
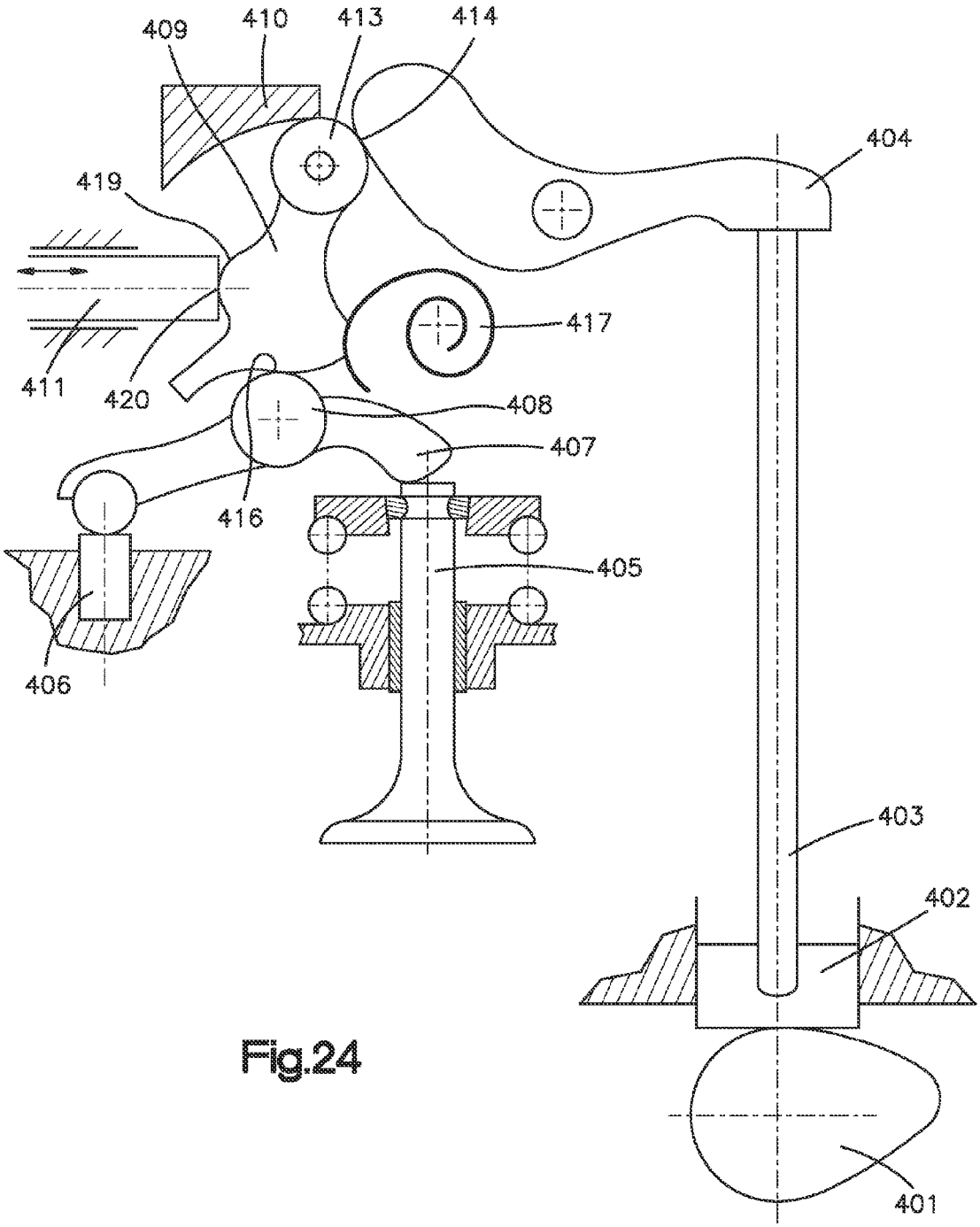
Figure 26:
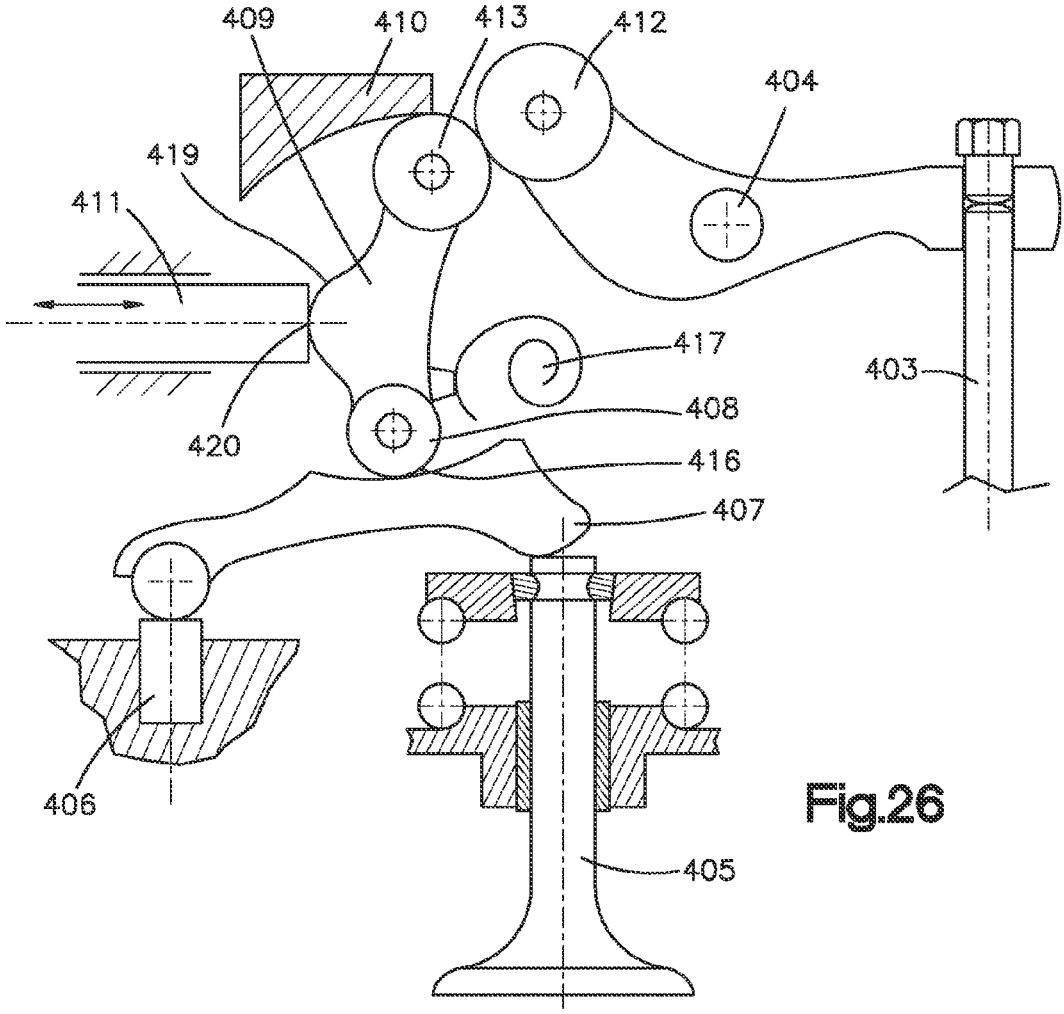
Figure 27:
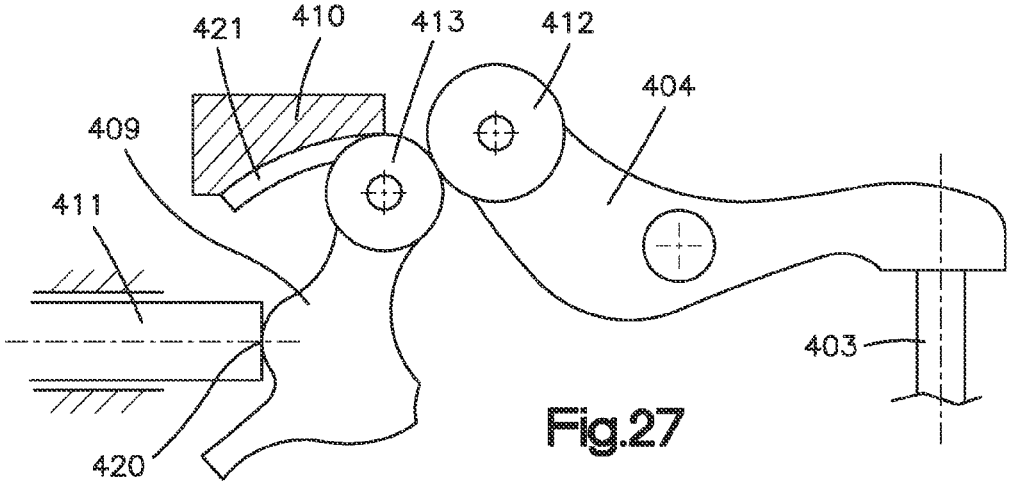

Shown are in:

FIG. 1 a perspective view of the valve lift system according to the invention;

FIG. 2 an eccentric shaft in section;

FIG. 3 an eccentric shaft with eccentrics, which are arranged distortedly, in section;

FIG. 4 an embodiment of an actuator according to the invention in perspective view;

FIGS. 5-11 embodiments of an actuator with a hydraulic adjustment element in different switching positions and diagrams;

FIG. 12 another embodiment of a device according to the invention;

FIGS. 13-19 further embodiments of an actuator with a hydraulic adjustment element in different switching positions and diagrams;

FIG. 20 another perspective view of a device according to the invention;

FIG. 21 another eccentric shaft in section;

FIG. 22 another eccentric shaft with eccentrics, which are arranged distortedly, in section;

FIG. 23 an opening characteristic of a valve;

FIG. 24 a first embodiment of a valve control system;

FIG. 25 the first embodiment in lateral view;

FIG. 26 a second embodiment of a valve control system;

FIG. 27 a third embodiment of a valve control; and

Figure 28:
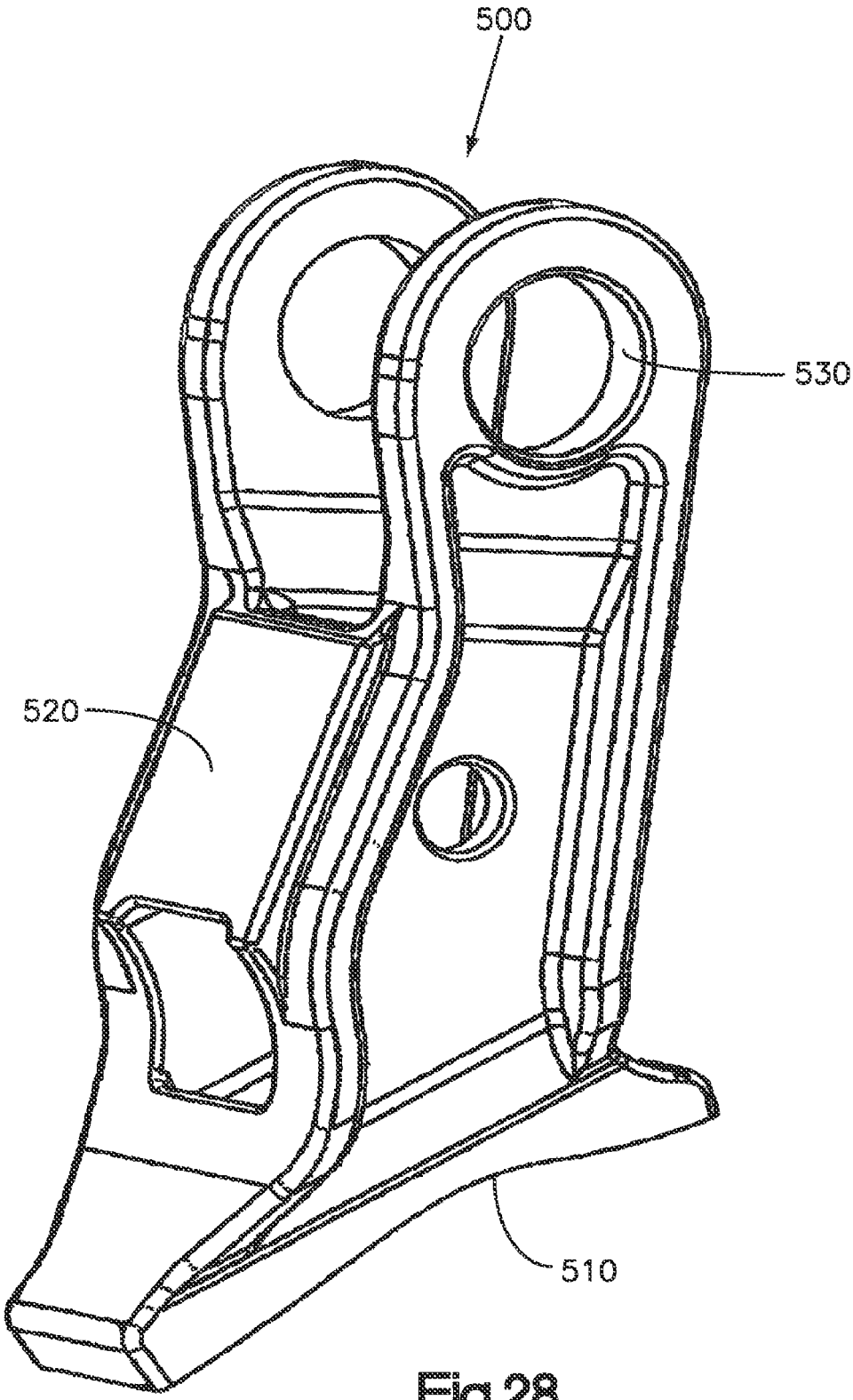

FIG. 28 an embodiment of a rocker lever according to the invention.

FIG. 1 shows a valve lift system for the variable lift adjustment of a gas-exchange valve 2 of a valve lift device 1, which shows a rotable eccentric shaft 3, which consists of several eccentrics 4, 5, wherein all possible contours of the eccentrics 4, 5 are within a circle, which is formed by means of the external diameters of a bearing 6, 7 of the eccentric shaft 3 (FIG. 2). The eccentric shaft 3 is pluggable through a through-going drilling in the cylinder head material, which is not shown, and is bedded directly in the through-going drilling within the cylinder head. Thereby, the eccentric shaft 3 can be mounted as pluggable eccentric shaft 3 from one of the front walls of the cylinder head. The eccentric shaft 3 is bedded in a separate housing, which is connected with the cylinder head. In the housing, the eccentric shaft 3, rocker levers 9, 10, a camshaft 8 and a slotted link 11 are bedded as pre-mounted unit. It is also possible bedding the eccentric shaft 3 by means of anti-friction bearings within the cylinder head.

The contours of the eccentrics 4, 5 can be formed as arbitrary contour, in particular as circle, and are limited by means of the external diameters of the bearing 6, 7 of the eccentric shaft 3. Thereby, the maximum diameter of the eccentric shaft 3 is provided for the bedding of the eccentric shaft 3 in particular within the cylinder head, and is bedded in the shortest distance to the rocker point and adjustment point of the rocker levers 9, 10. The eccentric shaft 3 is arranged parallelly to the camshaft 8. The eccentric shaft 3 is hydraulically adjustable or is adjustable by means of an electric engine, which is provided in an alignment with the camshaft 7 or with the eccentric shaft 3. Furthermore, the axis of the electric engine is provided parallelly to the axis of the camshaft or parallelly to the axis of the eccentric shaft. Thereby, that the eccentrics 4, 5 in an arrangement with two or several inlet valves or outlet valves are arranged towards each other distortedly at an angle $\alpha$ (FIG. 3), in an rotation position of the eccentric shaft 3 a different valve lift will result for the valves 2. In case that in one cylinder head several eccentric shafts 3 are provided for the actuation of inlet valves and outlet valves, then the eccentric shafts 3 of several inlet valves or outlet valves can differ in the contour of the eccentrics 4, 5. The valves 2 of contiguous cylinders can be actuated with different eccentric contours by means of the rocker levers 9, 10. The camshaft contours for the valves 2, which belong to one cylinder, can be formed differently.

The work contours of the rocker levers 9, 10, which are in contact with the eccentric shaft 3, can form a flat plane or a concave or convex plane. However, it is also possible that the eccentrics 4, 5 are in contact with a roller, which is bedded in friction-bearings or anti-friction bearings, in order to reduce the friction and the abrasion. However, for both bearings, smallest bearing clearance is assumed. A work contour 12 of the rocker lever 9 is formed differently from the work contour 13 of the second rocker level 10, which are connected directly by means of an axis 14.

FIG. 4 shows an actuator 101 for the lift adjustment of the gas-exchange valve 111, 112, which is arranged in a housing 102. The actuator 101, which is in this embodiment an electric engine, which is not shown in detail, and which is arranged in a black box, a housing 102, is arranged bottom-sided at a rotatable eccentric shaft 108, exchangeable for the distortion of the eccentric shaft 108, which is bedded in a known cylinder head, which is not shown in detail. The actuator 101 can also be formed as lift magnet or as actuator with a hydraulic adjustment element. According to FIG. 4, the actuator 101 is fixed by means of two mounting clips 103, 104, which are in particular arranged at the front wall of the housing 102 oppositely towards each other, at the cylinder head, which is not shown in detail, by means of the mounting elements, which are carried in the recesses 105, 106 of the mounting clips 103, 104. Furthermore, the actuator 101 is connected by means of a clutch 107 with the eccentric shaft 108 for the transfer of the actuator motion to the rotary motion of the eccentric shaft 108. In case that the actuator 101 is formed as lift magnet, then said actuator is also arranged in a black box. It is preferred providing several eccentrics 109, 110 on the eccentric shaft 108. The eccentric shaft 108 is bedded in a separate housing, which is not shown in detail, or is directly bedded within the cylinder head, whereby the housing is connected with the cylinder head. Furthermore, in the housing rocker levers 113, 114 are bedded besides the eccentric shaft 108. By means of the exchange of different actuators 1, a change-over of a valve lift adjustment takes place from a step-less variable valve lift adjustment to a stepwise change of the valve lift for the gas-exchange valves 111, 112 in such a manner, that at both valve sides fully variable, partially fully variable, stepwise or at both valve sides a stepwise change of the valve lift for the gas-exchange valves 111, 112 takes place. For the change-over, only the actuator 101 has to be changed, which is connected with the eccentric shaft 108 by means of the clutch 107. Dependent from the different embodiments, the actuator 101 cannot be provided in a direct alignment with the eccentric shaft 108, however, between the actuator 101 and the eccentric shaft 108 an intermediate gear box is provided, which is not shown in detail, whereby the corresponding actuators 101 are arranged in the upper region of the cylinder head either on the front wall or on the backside. In case that the actuator 101 is provided as electric engine, then the electric engine acts directly on the eccentric shaft 108. For a step-less fully variable valve lift adjustment of the gas-exchange valves 111, 112, the valve lift is additionally measured with a sensor, which is provided at the cylinder head and which is not shown in detail, whereby the position-feedback of the valve lift of the gas-exchange valves 111, 112 is required. In case that a change-over to a stepwise change of the valve lift of the gas-exchange valves 111, 112 takes place, then, at least from two to four valve positions are provided. In the change-over of the change of the valve lift of the gas-exchange valves 111, 112 to a stepwise fully variable change of the valve lift, the eccentric shaft 108 is provided with an exchangeable clutch 107.

The FIGS. 5-11 show embodiments of a hydraulic actuator 101 as actuator with two, three and four positions in different switching positions with the corresponding diagrams.

Figure 5A:
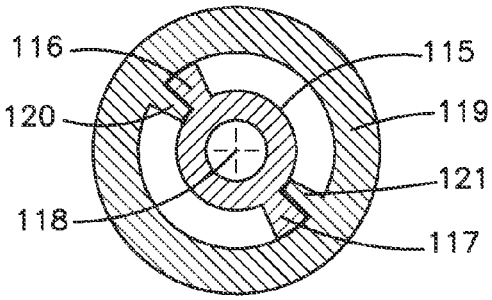
Figure 5B:
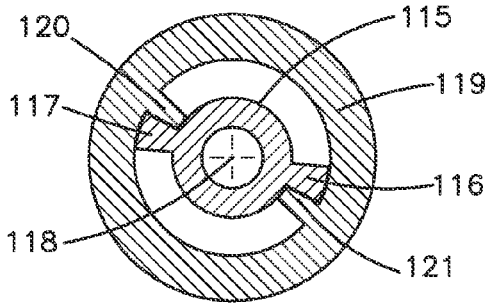

FIGS. 5*a* and 5*b* show an actuator 101, which is formed actuator with two positions with the hydraulic adjustment element in form of a rotor 115. Thereby, the rotor shows two rotor wings 116, 117 and is rotatable in a stator housing 119 around a rotation axis 118 in two switching positions according to FIGS. 5*a* and 5*b* up to the stop positions 120, 121.

Figure 6A:
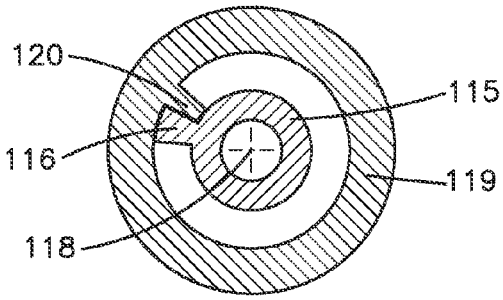
Figure 6B:
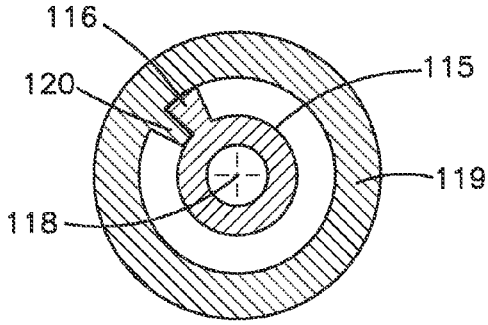

FIGS. 6*a* and 6*b* show an actuator 101, which is formed as actuator with two positions with the hydraulic adjustment element in form of the rotor 115. The rotor 115 thereby shows a rotor wing 116, and is rotatable in the stator housing around the rotation axis 118 for approximately 300° up to the stop positions 120, 121 in two switching positions according to FIGS. 6*a* and 6*b*.

Figure 7:
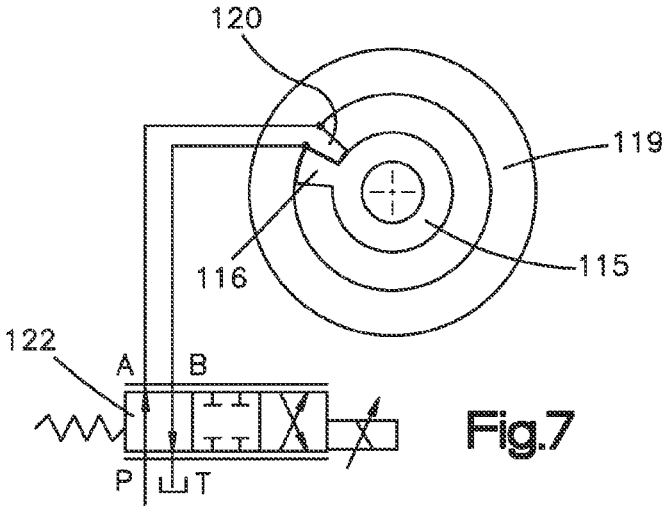

FIG. 7 shows a diagram example for a one-wing actuator and a 4/2-direction-control valve 122 for connections A and B, thereby, the direction-control valve 122 for the actuation of the actuator 101 can be positioned within the actuator 101, preferably coaxially to the actuator center line. The actuator 101 is preferably formed from plastics. The actuator 101 is fed with hydraulic oil pressure from the engine circulation, whereby the direction-control valve 122 for the actuation of the actuator 101 is mounted at the cylinder head, and is in particular positioned within the actuator 101, preferably coaxially to the actuator center line 118.

Figure 8A:
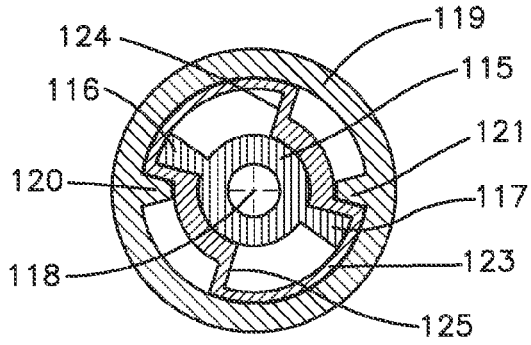
Figure 8B:
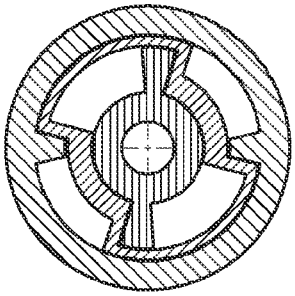
Figure 8C:
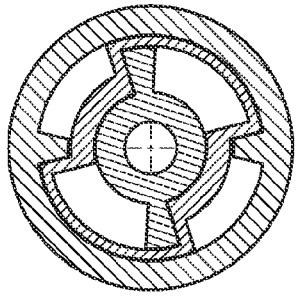

The FIGS. 8*a*, 8*b*, 8*c* show an actuator 101, which is formed as actuator with three positions with the hydraulic adjustment element in form of the internal rotor 115 with the rotor wings 116, 117, and an external rotor 123, which are rotatable within the stator housing 119 around the rotation axis 118 in three switching positions according to FIGS. 8*a*, 8*b*, 8*c* up to the stop positions 120, 121 of the internal rotor 115 and up to the stop positions 124, 125 for the external rotor 123.

Figure 9:
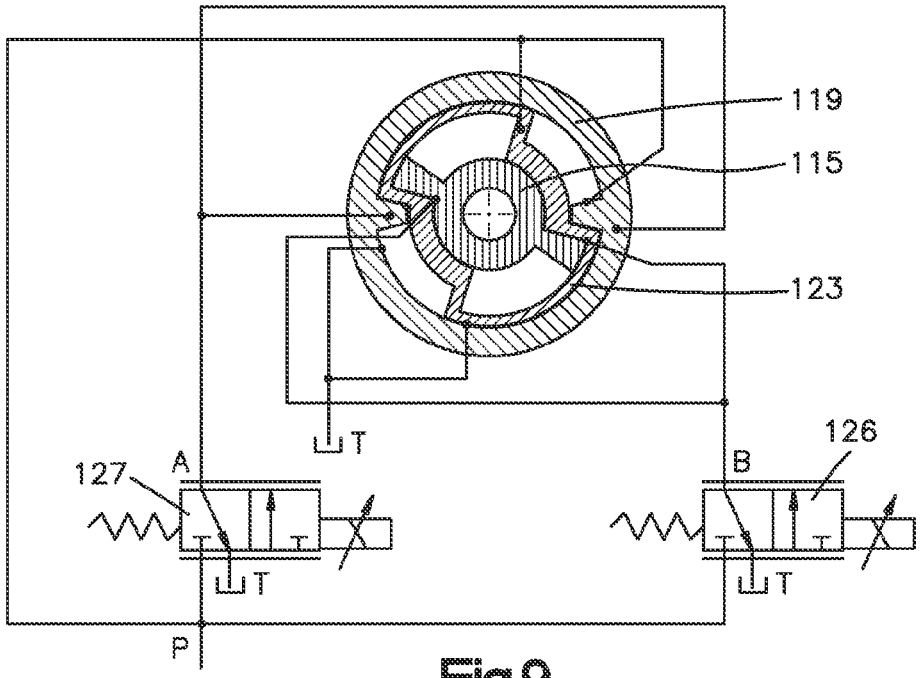
Figure 10A:
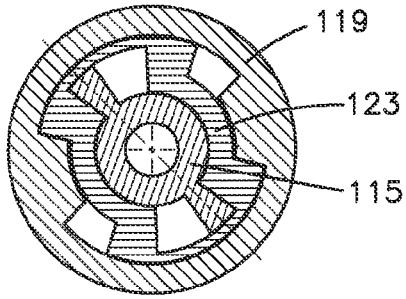
Figure 10B:
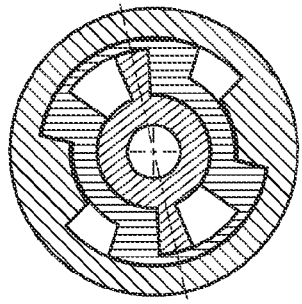
Figure 10C:
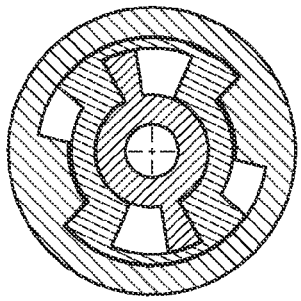
Figure 10D:
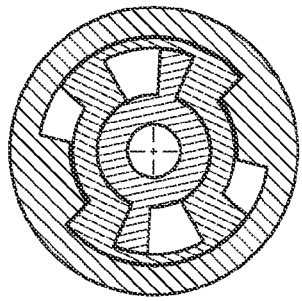

FIG. 9 shows a diagram example for an actuator with three positions and two 4/2-direction-control valves 126, 127 for the connections A and B.

The FIGS. 10*a*, 10*b*, 10*c*, 10*d* show an actuator 101, which is formed as actuator with four positions with the hydraulic adjustment element in form of the internal rotor 115 and the external rotor 123, which are rotatable within the stator housing 119 around the rotation axis 118 in four switching positions according to the FIGS. 10*a*, 10*b*, 10*c*, 10*d*.

Figure 11:
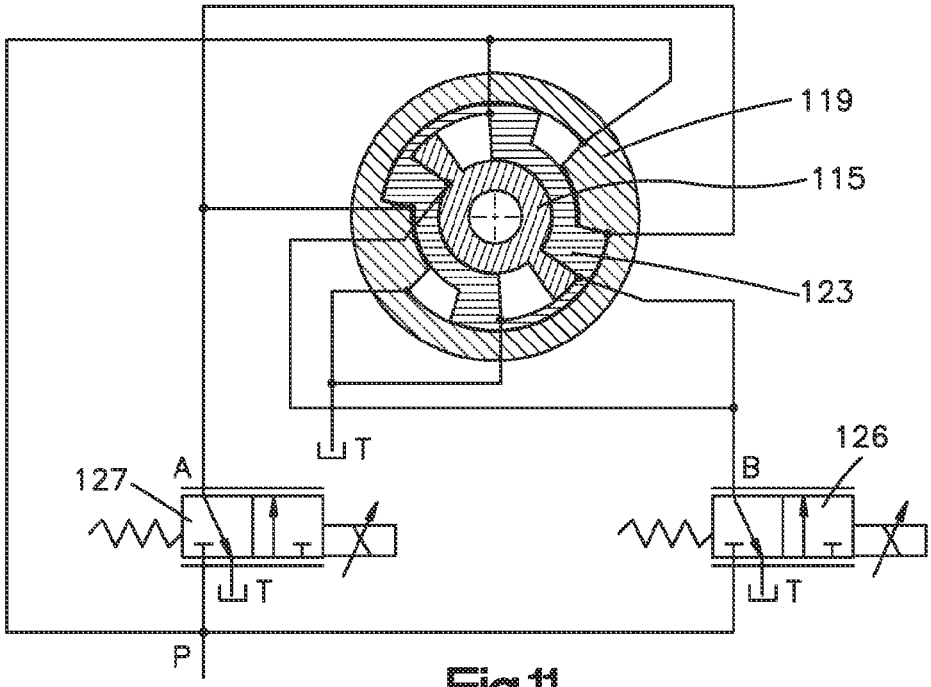

FIG. 11 shows a diagram example for an actuator with four positions and two 4/2-direction-control valves 126, 127 for the connections A and B.

FIG. 12 shows a device according to the invention with a camshaft adjustment unit 230, which preferably is provided at one end of the camshaft 232 in the axial extension thereof, an eccentric shaft 208 and an actuator 1 for the lift adjustment of a gas-exchange valve 211 or 212, which is arranged in a housing 202. The actuator 201, which in this embodiment is an electric engine, which is not shown in detail, and which is arranged in a black box, a housing 202, is arranged bottom-sided at the rotatable eccentric shaft 208, exchangeable for the distortion of the eccentric shaft 208, which is bedded in a known cylinder head, which is not shown in detail. The actuator 201 can also be formed as lift magnet or as actuator with a hydraulic adjustment element. According to FIG. 12, the actuator 201 is mounted at the cylinder head, which is not shown in detail, by means of the mounting elements, in particular by means of two mounting clips 203 and 204, which are in particular arranged at the front wall of the housing 202 oppositely towards each other, which are carried in the recesses 205 and 206 of the mounting clips 203 and 204. Furthermore, the actuator is connected by means of a clutch 207 with the eccentric shaft 208 for the transfer of the actuator motion to the rotary motion of the eccentric shaft 208. In case that the actuator 201 is formed as lift magnet, then said lift magnet is also arranged in a black box. It is preferred providing several eccentrics 209 and 210 on the eccentric shaft 208, for instance for internal combustion engines with more than one inlet valve per cylinder. The eccentric shaft 208 is bedded in a separate housing, which is not shown in detail, and which is connected with the cylinder head. Besides the eccentric shaft 208, also roller cam followers 213 and 214 are bedded in the housing, which act on the gas-exchange valves 211 and 212. By means of the eccentric shaft 208, the motion of rocker levers 236 and 238 is influenced, which are driven by means of a cam 234 of the camshaft 232, respectively. By means of the exchange of different actuators 201, a change-over of a valve lift adjustment from a step-less variable valve lift adjustment to a stepwise change of the valve lift for the gas-exchange valves 211 and 212 takes place, such that at both valves sides fully variable, partially fully variable, stepwise or that on both valve sides a stepwise change of the valve lift for the gas-exchange valves 211 and 212 takes place. For the change-over, only the actuator 201, which is connected by means of the clutch 207 with the eccentric shaft 208, has to be changed. Dependent on the different embodiments, the actuator 201 cannot be provided in a direct alignment with the eccentric shaft 208, however, then, between the actuator 201 and the eccentric shaft 208 an intermediate gear box is provided, which is not shown in detail, whereby the corresponding actuators 201 are arranged in the upper region of the cylinder head either on the front wall or on the backside. In case that the actuator 201 is provided as electric engine, then the electric engine acts directly on the eccentric shaft 208. For a step-less fully variable valve lift adjustment of the gas-exchange valves 211 and 212, the valve lift is additionally measured with a sensor, which is provided at the cylinder head, and which is not shown in detail, whereby a position-feedback of the valve lift of the gas-exchange valves 211 and 212 is required.

In case of a change-over to a stepwise change of the valve lift of the gas-exchange valves 211 and 212, then at least from two to four valve positions are provided. For the change-over of the change of the valve lift of the gas-exchange valves 211 and 212 to a step-less, fully variable change of the valve lift, the eccentric shaft 208 is provided with an exchangeable clutch 207.

The FIGS. 13-19 show embodiments of a hydraulic actuator 201 as actuator with two, three and four positions, in different switching positions with the corresponding diagrams.

Figure 13A:
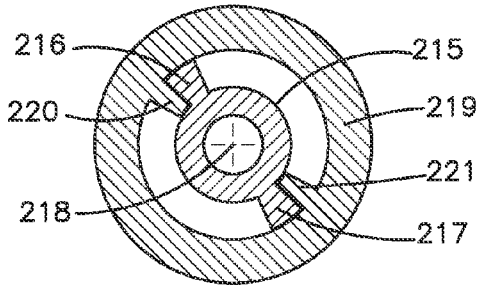
Figure 13B:
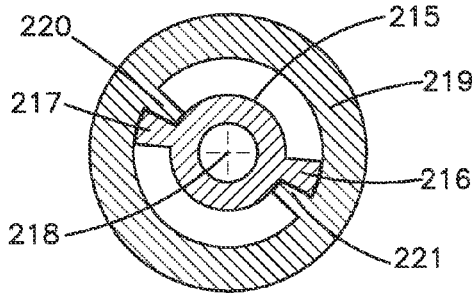

FIGS. 13*a* and 13*b* show an actuator 201, which is formed as actuator with two positions with a hydraulic adjustment element in form of a rotor 215. Thereby, the rotor 215 shows two rotor wings 216, 217, and is rotatable in a stator housing 219 around a rotation axis 218 for 180° in two switching positions up to the stop positions 220, 221 according to FIGS. 13*a* and 13*b*.

Figure 14A:
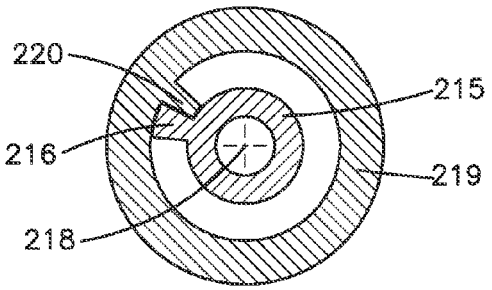
Figure 14B:
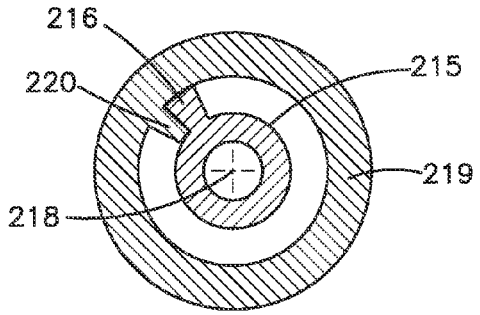

FIGS. 14*a* and 14*b* show an actuator 201, which is formed as actuator with two positions with the hydraulic adjustment element in form of the rotor 215. Thereby, the rotor 215 shows a rotor wing 216, and is rotatable within the stator housing 219 around the rotation axis 218 for 270° in two switching positions according to FIGS. 14*a* and 14*b* up to the stop positions 220, 221.

Figure 15:
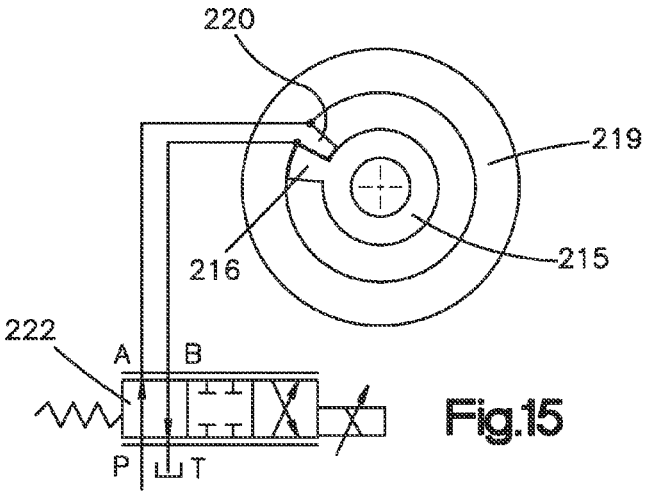

FIG. 15 shows a diagram example for a one-wing actuator and a 4/2-direction-control valve 222 for the connections A and B, thereby, the direction-control valve 222 for the actuation of the actuator 201 can be positioned within the actuator 201, preferably coaxially to the actuator center line. The actuator 201 is preferably formed from plastics. The actuator 201 is fed with hydraulic oil pressure from the engine circulation, whereby the direction-control valve 222 for the actuation of the actuator 201 is mounted at the cylinder head, and is preferably positioned within the actuator 201, preferably coaxially to an actuator center line 218.

Figure 16A:
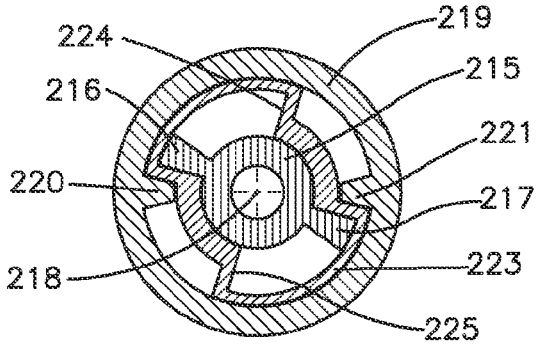
Figure 16B:
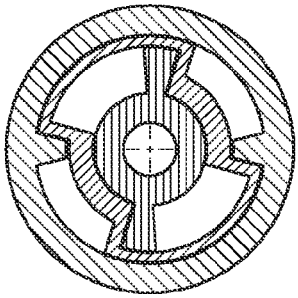
Figure 16C:
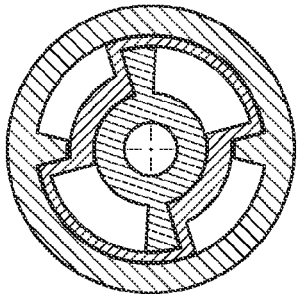

The FIGS. 16*a*, 16*b*, and 16*c* show an actuator 201, which is formed as actuator with three positions with the hydraulic adjustment element in form of the internal rotor 215 with the rotor wings 216, 217, and an external rotor 223, which are rotatable in the stator housing 219 around the rotation axis 218 for 180° in three switching positions according to FIGS. 16*a*, 16*b*, 16*c*, up to the stop positions 220, 221 of the internal rotor 215, and up to the stop positions 224, 225 for the external rotor 223.

Figure 17:
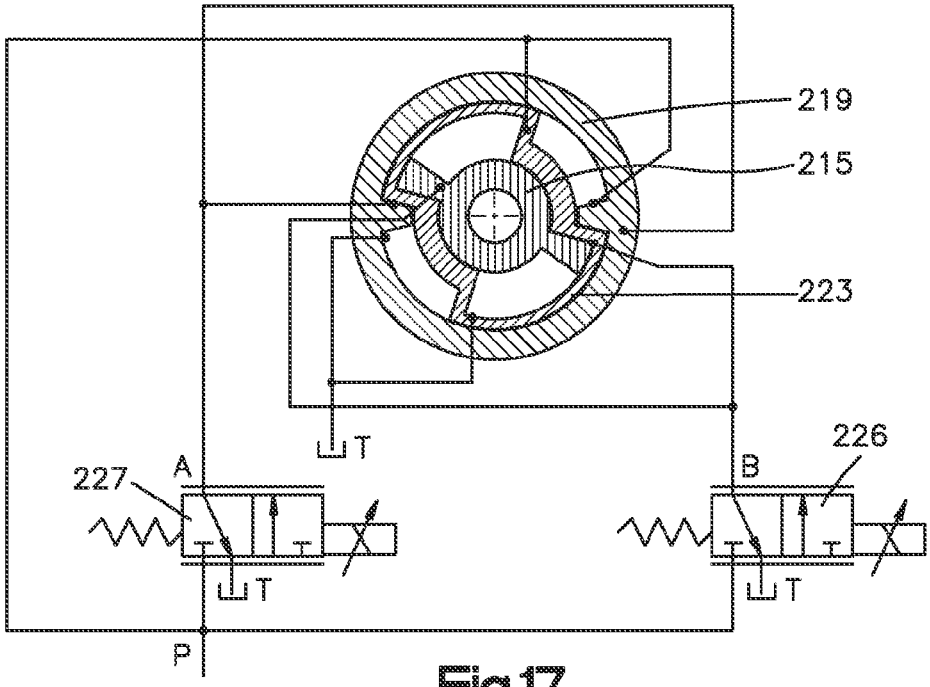
Figure 18A:
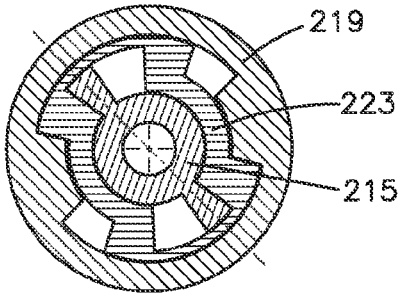
Figure 18B:
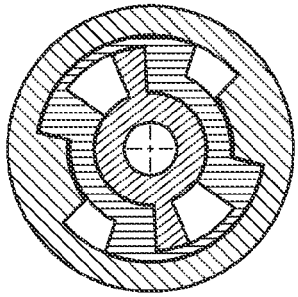
Figure 18C:
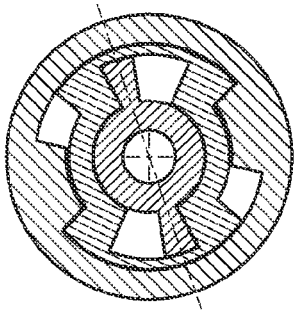
Figure 18D:
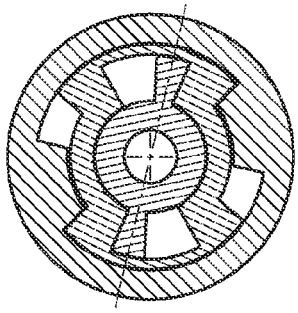

FIG. 17 shows a diagram example for an actuator with three positions and two 4/2-direction-control valves 226, 227 for connections A and B.

The FIGS. 18*a*, 18*b*, 18*c* and 18*d* show an actuator 201, which is formed as actuator with four positions with the hydraulic adjustment element in form of the internal rotor 215 and the external rotor 223, which are rotatable within the stator housing 219 around the rotation axis 218 in four switching positions according to FIGS. 18*a*, 18*b*, 18*c*, 18*d*.

Figure 19:
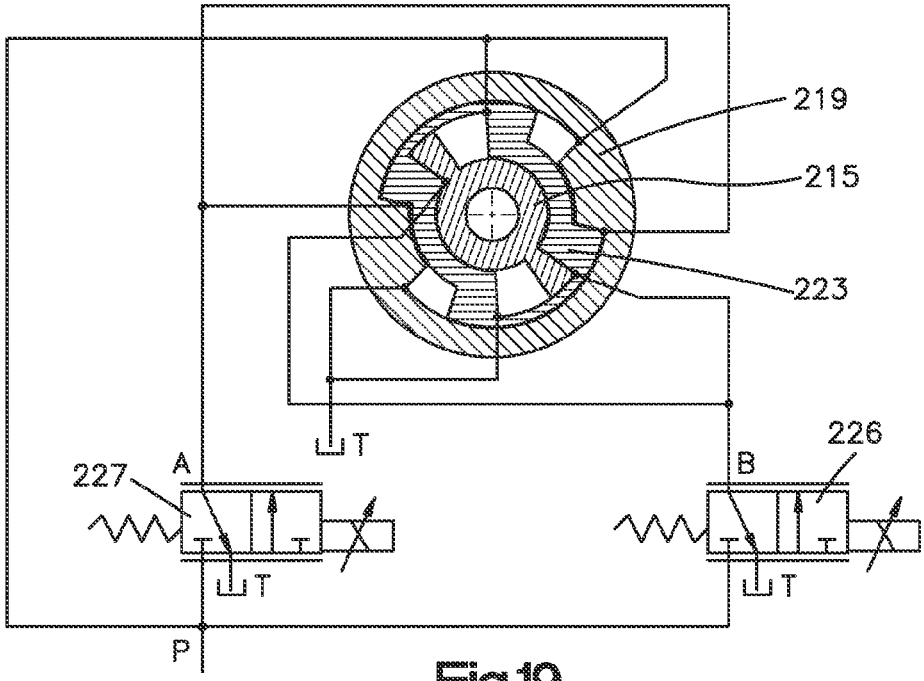

FIG. 19 shows a diagram example for an actuator with four positions and two 4/2-direction-control valves 226, 227 for connections A and B.

FIG. 20 shows a device 310 according to the invention for the variable valves lift adjustment of two gas-exchange valves 312 and 314, for instance two inlet valves of a cylinder, which shows a rotatable eccentric shaft 316, which, in this embodiment, is constructed from two eccentric shaft parts 318 and 320, which are arranged coaxially towards each other, whereby one eccentric 322 preferably is an integral part of the eccentric shaft part 318 and one eccentric 324 is preferably integral part of the eccentric shaft part 320. The both eccentric shaft parts 318 and 320, which are nested coaxially, and which can move independently from each other, are in contact with each other at one connection position 330, observable from the outside. In principle, said position can be provided at any position between the two eccentrics 322 and 324. For stability reasons, the connecting position 330 is provided being existent at one bearing position, what, however, is basically not mandatory. Preferably, all possible contours of the eccentrics 322 and 324 are positioned within a circle, which is formed by means of the external diameters of a bearing 326 and 328 of the eccentric shaft 316 (compare FIG. 21). The eccentric shaft 316 is pluggable through a through-going drilling in the cylinder head material, which is not shown, and is bedded directly in the through-going drilling within the cylinder head. Thereby, the eccentric shaft 316 can be mounted as pluggable eccentric shaft 316 from one of the front walls of the cylinder head. Preferably, the eccentric shaft 316 is bedded in a separate housing (not shown), which is connected with the cylinder head. In the housing, the eccentric shaft 316, rocker levers 332 and 334, one camshaft 336 and a slotted link 338 are bedded as pre-mounted unit. It is also possible bedding the eccentric shaft 316 by means of anti-friction bearings within the cylinder head.

The contours of the eccentrics 322 and 324 can be formed as arbitrary contours, in particular as circle, and are limited by the external diameters of the bearings 326 and 328 of the eccentric shaft 316. Thereby, in particular, the maximum diameter of the eccentric shaft 316 is provided for the bearing of the eccentric shaft 316 within the cylinder head, and, preferably, is bedded in the shortest distance to the rocker point and adjustment point of the rocker levers 332 and 334. Preferably, the eccentric shaft 316 is arranged parallelly to the camshaft 336.

For the distortion of the individual eccentric shaft parts 318 and 320, an actuator 340 is preferably connected by means of a clutch element 342 with the eccentric shaft 316. Thereby, preferably, the actuator 340 is arranged in an aligned manner with the rotation axis 344 of the eccentric shaft 316. The actuator 340 is protected by means of a housing 346, which can be connected with the cylinder head respectively the housing, in which the eccentric shaft 316 is bedded, by means of appropriate mounting devices 348. For instance, the actuator 340 can show hydraulic, electric or magnetic devices for the distortion or adjustment of the angle of the eccentric shaft 316. Besides the mentioned devices, also alternative devices as well as combinations of the mentioned devices are conceivable. The adjustment axis of the actuator 340 can further be provided parallelly to the camshaft axis or parallelly to the eccentric shaft axis.

Due to the possibility that the eccentrics 322 and 324 can be arranged in an arrangement with, for example, two or more several inlet valves or outlet valves, distorted towards each other at an angle $\alpha$ (compare FIG. 22), in a rotation position of the eccentric shaft parts 318 and 320, for the valves 312 and 314 a different valve lift can arise.

In case that in one cylinder head for the actuation of inlet valves and outlet valves several eccentric shafts 316 are provided, then the eccentric shafts 316 of several inlet valves or outlet valves can differ in the contour of the eccentrics 322 and 324. The valves of two contiguous cylinders can be actuated with different eccentric contours by means of the rocker levers 332 and 334. The camshaft contours of the camshaft 336 can also be formed differently for the valves 312 and 314, that belong to one cylinder.

The work contours of the rocker levers 332 and 334, which are in contact with the eccentrics 322 and 324 of the eccentric shaft 316, can form a flat, concave or convex plane. However, it is also possible that the eccentrics 322 and 324 are in contact with a roller, which is bedded in the corresponding rocker levers 332 and 334, for example, by means of friction bearings or anti-friction bearings, in order to reduce the friction and the abrasion. However, for both bearings, lowest bearing clearance is assumed.

Each of the rocker levers 332 and 334 shows a work contour, which is engaged with a means for valve actuation 350 and 352. As means for valve actuation 350 and 352, for example, a roller cam follower can be applied, as presented in FIG. 20. Each of the two means for valve actuation 350 and 352 transfers the motion of the corresponding rocker lever 332 or 334 to one of the valves 312 or 314. Furthermore, it is preferred providing valve clearing adjustment elements 354 and 356.

In another embodiment, which is not shown, the rocker lever can show a roller in place of the work contour, and the means for valve actuation can show the work contour. In both described embodiments, the work contours of different rocker levers, which are preferably connected with each other directly by means of an axis 358, or of different means for valve actuation, can be formed differently.

The rocker levers 332 and 334 are pressed by means of a spring 360 to the camshaft 336.

For a valve operating mechanism, for which together with the valve lift also the opening time is changed, according to FIG. 23 also the overcutting and the inlet closing time can be adjusted load-dependently and rotational speed-dependently. In particular, it is possible minimizing in the idle-running the overcutting in order to improve the idle-running quality, controlling in the part-load operational range the overcutting and therewith the residual gas portion by means of the valve lift, and improving for the full-load by means of a control of the intake-valve closing the torque and the performance. This takes place by means of the first embodiment of a valve lift control system, which is shown in FIG. 24, with the different characteristics a, b, c and d, which are shown in FIG. 23. Because, for the new valve operating mechanism according to the invention, there is no need considering longer a compromise between idle-running quality and maximum performance, as it is the case for fixed ocercuttings respectively determined control times, for high rotational speed also a valve lift can be run with an opening time, which was common as yet for sport engines, which could set aside any idle-running quality.

The effectiveness of the technical solution according to the invention is improved as to the fuel consumption by means of an additional phase slider on the camshaft, by means of which the fuel consumption in the part-load operational range is additionally improved in the load operational range without choke by means of an early intake closing. With a phase slider on the camshaft, for a cold engine and for a cold catalyst, the outlet spread or the opening time of the outlet valve can be shifted such that energy-rich exhaust gas streams into the catalyst and heats up the catalyst faster.

A first embodiment of a valve lift operating mechanism with variable valve lift and an opening period, which is adjusted in dependence from the valve lift, is shown in FIG. 24. An underneath camshaft 401 drives by means of a push rod 403 and by means of a hydraulic valve clearance adjustment element 402 a rocker lever 404. The rocker lever 404 has a curve contour 414, which runs on a roller 413 of an intermediate lever 409. Thereby, the intermediate lever 409 is bedded on an axis 418. At the end of the axis 418 (FIG. 25), two rollers 415 are arranged. Thereby, the rollers 415 run in slotted links 410, which are connected with a cylinder head in a fixed manner. The intermediate lever 409 supports at an adjustment bar 411, which is conducted in a housing, and rolls with a work curve 416 on a roller 408 of a cam follower 407, which is bedded at a housing. The cam follower 407 supports on a hydraulic adjustment element 406 and a valve 405 of a combustion engine. By means of a shifting of the adjustment bar 411, the region of the work curve 416 of the intermediate lever 409 is adjusted with the roller 408 of the cam follower 407, which is applied in a rotation of the camshaft 401. Therewith, the valve lift, and dependent thereof, the opening time of a valve 405 is adjusted. The work curve 416 of the intermediate lever 409 is constructed from several individual regions. For instance, one region describes the so-called zero-lift, which is defined by means of a circular arc around the center of the roller 413. Following at it is a region, which defines the opening ramp, following at it there is a part-lift region and a full-lift region. All individual regions are connected with each other by means of transition radii. Then, a spline is laid over the whole region, which connects all curve regions with each other without shock. In a similar manner, the curve contour 414 of the rocker lever 404 is formed. By means of an embossment of the camshaft 401, by means of the curve contour 414 of the rocker lever 404 and by means of the work curve 416 of the intermediate lever 409, the opening characteristic according to FIG. 23 of the cam mechanism is determined.

In a second embodiment according to FIG. 26, the work curve 416 is arranged at the cam follower 407 and the roller 408 is constituent part of the intermediate lever 409. Furthermore, the intermediate lever 409 supports according to FIG. 26 at the adjustment bar 411 with a circular contour 419. In another, non-exemplified embodiment, said contour can support also on a roller, which is bedded in a friction bearing or anti-friction bearing.

In a third embodiment according to FIG. 27, the rocker level 404 has a roller 412, which runs directly with the roller 413 of the intermediate lever 409. The intermediate lever 409 can be conducted axially through a leg spring 417 or through a slotted link 410 with a lateral line 421. In another, non-exemplified embodiment, the adjustment bar 411 can also provide another contour, for instance circular arc-shaped, concave, ascending and sloping, whereby by means of the form of the contour 419 of the intermediate lever 409 and the contact contour 420 of the adjustment bar 411 inter alia also the acceleration behavior of the valve 405 of the internal combustion engine is influenced.

In another, non-exemplified embodiment, for an internal combustion engine with several inlet valves and outlet valves, the valves can be controlled with different valve lifts and coupled therewith different opening times. Then, this can be carried out by means of several adjustment bars 411, which are controlled by means of individual actuators. Thereby, the corresponding set value is calculated by means of a process-controlled characteristic diagram, or by means of a program-controlled model. The control of the valve lift can also take place by means of several, non-exemplified eccentric shafts. For Diesel engines, by means of an individual control of the valve lift of, for instance, two inlet valves, the twist of the in-cylinder flow can be controlled.

In case of Otto engines, via the individual control of, for instance, two inlet valves, the in-cylinder flow can also be adjusted in such a manner, that the combination with a fuel injection valve, which injects the fuel directly into the combustion chamber, is facilitated in broad operating ranges. The combination of a fuel inlet valve, which injects directly, with a valve operating mechanism with underneath camshaft, facilitates new possibilities in the arrangement of the fuel injection valve within the combustion chamber, because a restriction by means of an overhead camshaft is not existent.

Advantageous alternatives of the embodiments are seen therein that either the adjustment element is omitted or that no valve clearance adjustment element is applied and the intermediate lever is formed from aluminum or a titanium alloy.

Further advantageous embodiments are seen therein that either all rollers are bedded by means of anti-friction bearings, or that the rollers are bedded by means of anti-friction bearings and friction bearings, and that the rocker level is bedded by means of anti-friction bearings or friction bearings.

Owing to the circumstances, another advantageous embodiment is seen therein that no adjustment elements have to be applied, and that then the valve clearance is mechanically adjustable at the rocker lever.

FIG. 28 shows a preferred embodiment of a rocker lever 500 according to the invention with a work curve 510, which acts on a means for actuating a valve (not shown), as for example a roller cam follower. An advantage of the presented rocker lever 500 is the flat contour 520, by means of which the rocker lever supports on an adjustment element, which changes its operational center of rotation, as for example an adjustment bar or an eccentric shaft (not shown). Basically, the form of the contour is freely selectable, as long it is suited ensuring the contact to the adjustment element, in particular during the operation modus. At one end of the rocker lever 500, a recess is provided, which is suited carrying an axis, on which, preferably, a roller is arranged. For example, said roller contacts a cam of a camshaft. The rocker lever 500, which is shown in FIG. 28, is preferably applied as rocker lever in the devices according to the invention, as shown in the Figures, which are described before.

LIST OF REFERENCE NUMERALS

1 valve lift device
2 valve
3 eccentric shaft
4 eccentric
5 eccentric
6 external diameter of the bearing of the eccentric shaft
7 external diameter of the bearing of the eccentric shaft
8 camshaft
9 rocker lever
10 rocker lever
11 slotted link
12 work contour of the rocker lever
13 work contour of the rocker lever
14 axis of the rocker levers
101 actuator
102 housing
103 mounting element
104 mounting element

105' recess in the mounting element
106 recess in the mounting element
107 clutch
108 eccentric shaft
109 eccentric
110 eccentric
111 gas-exchange valve
112 gas-exchange valve
113 rocker lever
114 rocker lever
115 rotor
116 rotor wing
117 rotor wing
118 rotation axis
119 stator housing
120 stop position within the stator housing
121 stop position within the stator housing
122 direction-control valve
123 external rotor
124 stop position within the external rotor
125 stop position within the external rotor
126 direction-control valve
127 direction-control valve
201 actuator
202 housing
203 mounting element
204 mounting element
205 recess in the mounting element
206 recess in the mounting element
207 clutch
208 eccentric shaft
209 eccentric
210 eccentric
211 gas-exchange valve
212 gas-exchange valve
213 roller cam follower
214 roller cam follower
215 rotor
216 rotor wing
217 rotor wing
218 rotation axis
219 stator housing
220 stop position in the stator housing
221 stop position in the stator housing
222 direction-control valve
223 external rotor
224 stop position within the external rotor
225 stop position within the external rotor
226 direction-control valve
227 direction-control valve
230 camshaft adjustment unit
232 camshaft
234 cams
236 rocker lever
238 rocker lever
310 device for variable valve lift adjustment
312 gas-exchange valve
314 gas-exchange valve
316 eccentric shaft
318 eccentric shaft part
320 eccentric shaft part
322 eccentric
324 eccentric
326 external diameter of the bearing of the eccentric shaft
328 external diameter of the bearing of the eccentric shaft
330 connection position
332 rocker lever
334 rocker lever
336 camshaft
338 slotted link
340 actuator
342 clutch element
344 rotation axis
346 housing
348 mounting device
350 means for valve actuation
352 means for valve actuation
354 valve clearance adjustment element
356 valve clearance adjustment element
358 axis of the rocker levers
360 spring
401 camshaft
402 valve clearance adjustment element
403 push rod
404 rocker lever
405 valve
406 adjustment element
407 cam follower
408 roller of the cam follower 407
409 intermediate lever
410 slotted link
411 adjustment bar
412 roller of the rocker lever 404
413 roller of the intermediate lever 409
414 curve contour of the rocker lever 404
415 roller
416 work curve of the intermediate lever 409
417 leg spring
418 axis
419 contour of the intermediate lever 409
420 contact contour of the adjustment bar 411
421 lateral line of the slotted link
500 rocker lever
510 work curve
520 contour
530 recess

The invention claimed is:

1. Variable valve lift device for the lift adjustment of gas-exchange valves of an internal combustion engine with one arrangement or two arrangements of following elements:

a rocker lever with a work curve, which runs in a slotted link actuated by means of a camshaft, whereby the center of rotation of the rocker lever is determined by means of an eccentric, in order to adjust the valve lift of an gas-exchange valve, a means for valve actuation and a spring, which presses the rocker lever against a cam of the camshaft, and a spring, which presses the rocker lever against an eccentric shaft, characterized in that:

a valve lift device (1) shows a rotatable eccentric shaft (3) which consists of several eccentrics (4,5) and whereby the eccentrics (4,5) are positioned within a circle, which is formed by the external diameter of a bearing (6,7) of the eccentric shaft (3).

2. Valve lift device according to claim 1, characterized in that the eccentric shaft (3) is pluggable through a through-going drilling in the cylinder head material, and is bedded directly in the through-going drilling in the cylinder head.

3. Valve lift device according to claim 1, characterized in that the eccentric shaft (3) is mountable as pluggable eccentric shaft (3) from one of the front walls of the cylinder head.

4. Valve lift device according to claim 1, characterized in that the eccentric shaft (3) is bedded in a separate housing, which is connected with the cylinder head.

5. Valve lift device according to claim 4, characterized in that a camshaft (8) is bedded within the housing.

6. Valve lift device according to claim 4, characterized in that in the housing the eccentric shaft (3), rocker levers (9, 10), the camshaft (8) and the slotted link (11) is bedded as pre-mounted unit.

7. Valve lift device according to claim 1, characterized in that the eccentric shaft (3) is bedded within the cylinder head by means of anti-friction bearings.

8. Valve lift device according to claim 1, characterized in that the eccentric has a circular radially-outer surface and is limited by means of the external diameters of the bearing (6, 7) of the eccentric shaft (3).

9. Valve lift device according to claim 1, characterized in that the maximum diameter of the eccentric shaft (3) is provided as bearing of the eccentric shaft (3) within the cylinder head.

10. Valve lift device according to claim 1, characterized in that the eccentric shaft (3) is arranged parallelly to the camshaft (8).

11. Valve lift device according to claim 1, characterized in that the eccentric shaft (3) is hydraulically adjustable.

12. Valve lift device according to claim 1, characterized in that the eccentric shaft (3) is adjustable by means of an electric engine, which is provided in an alignment with the camshaft (7) or with the eccentric shaft (3).

13. Valve lift device according to claim 12, characterized in that the axis of the electric engine is provided parallelly to the camshaft axis or parallelly to the eccentric shaft axis.

14. Valve lift device according to claim 1, characterized in that the eccentrics (4, 5) in an arrangement with two or several inlet valves or outlet valves are arranged distortedly towards each other at an angle a, so that in a rotation position of the eccentric shaft (3) a different valve lift results for the valves (2).

15. Valve lift device according to claim 1, characterized in that in one cylinder head for the actuation of inlet valves and outlet valves several eccentric shafts (3) are provided.

16. Valve lift device according to claim 15, characterized in that the eccentric shafts (3) of several inlet valves or outlet valves differ with respect to the contour of the eccentrics (4, 5).

17. Valve lift device according to claim 16, characterized in that the valves (2) of contiguous cylinders with different eccentric contours are to be actuated by means of rocker levers (9, 10).

18. Valve lift device according to claim 1, characterized in that camshaft contours for the valves (2), which belong to one cylinder, are formed differently.

19. Valve lift device according to claim 1, characterized in that work contours of rocker levers (9, 10), which are in contact with the eccentric shaft (3), form a flat plane.

20. Valve lift device according to claim 1, characterized in that work contours of rocker levers (9, 10), which are in contact with the eccentric shaft (3), form a concave or convex plane.

21. Valve lift device according to claim 1, characterized in that the eccentrics (4, 5) are in contact with a bedded roller of rocker levers (9, 10).

22. Valve lift device according to claim 1, characterized in that the work contour (12) of the rocker lever (9) is formed differently from the work contour (13) of the second rocker lever (10), which are directly connected with each other by means of an axis (14).

* * * * *